US007259315B2

(12) United States Patent
Tamura et al.

(10) Patent No.: US 7,259,315 B2
(45) Date of Patent: Aug. 21, 2007

(54) WAVEFORM PRODUCTION METHOD AND APPARATUS

(75) Inventors: Motoichi Tamura, Hamamatsu (JP); Yasuyuki Umeyama, Hamamatsu (JP); Hideyuki Masuda, Hamamatsu (JP); Eiji Akazawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 685 days.

(21) Appl. No.: 10/107,865

(22) Filed: Mar. 26, 2002

(65) Prior Publication Data

US 2002/0143545 A1 Oct. 3, 2002

(30) Foreign Application Priority Data

Mar. 27, 2001 (JP) ..... 2001-091186
Mar. 27, 2001 (JP) ..... 2001-091187
Mar. 27, 2001 (JP) ..... 2001-091188

(51) Int. Cl.
*G10H 1/00* (2006.01)

(52) U.S. Cl. ..... 84/627; 84/629; 84/663

(58) Field of Classification Search ..... 84/627, 84/629, 663, 702, 706
See application file for complete search history.

(56) References Cited

U.S. PATENT DOCUMENTS 5,086,685 A 2/1992 Hanzawa et al.
5,481,066 A 1/1996 Kitamura
5,756,917 A 5/1998 Watanabe et al.
5,763,800 A * 6/1998 Rossum et al. ..... 84/603
5,900,568 A * 5/1999 Abrams ..... 84/622
6,150,598 A 11/2000 Suzuki et al.
6,316,710 B1 * 11/2001 Lindemann ..... 84/609
6,584,442 B1 6/2003 Suzuki et al.

FOREIGN PATENT DOCUMENTS

EP 0 856 830 A 8/1998
EP 0907160 A1 4/1999
EP 1028409 A2 8/2000
EP 1 039 442 A 9/2000
JP 04-284496 10/1992

(Continued)

*Primary Examiner*—Lincoln Donovan
*Assistant Examiner*—David S. Warren
(74) *Attorney, Agent, or Firm*—Morrison & Foerster LLP

(57) ABSTRACT

Performance event data designating rendition style modules are supplied in order of time. When a given performance event data at a given time is to be processed in accordance with the supplied performance event data, another performance event data related to one or more events, following the given performance event data, is obtained in advance of a predetermined original time position of the other performance event daata. Control data corresponding to a rendition style module designated by at least one of the given performance event data and the other performance event data obtained in advance is generated on the basis of the given and the other performance event data, and a waveform corresponding to the designated rendition style module is synthesized on the basis of the control data. Characteristic of at least one of preceding and succeeding rendition style modules is modified on the basis of trailing end information of the preceding rendition style module and leading end information of the succeeding rendition style module. When rendition style designation data, including information designating a rendition style module and parameters for controlling the rendition style module, is lacking in a necessary parameter, the lacking parameter is filled with a predetermined standard parameter.

29 Claims, 11 Drawing Sheets

FOREIGN PATENT DOCUMENTS

| | | |
|---|---|---|
| JP | 11-167382 | 6/1999 |
| JP | 2000-122665 | 4/2000 |
| JP | 2000-122666 | 4/2000 |
| JP | 2000-276174 | 10/2000 |
| JP | 2000-330565 | 11/2000 |

* cited by examiner

RENDITION EVENT TRAIN OBJECT (ONE PART)

| | |
|---|---|
| EV1 | Ts1 |
| EV2 | Ts2 |
| EV3 | Ts3 |
| EV4 | Ts4 |
| ⋮ | ⋮ |

t0

TIME

WAVEFORM PRODUCTION METHOD AND APPARATUS

BACKGROUND OF THE INVENTION

The present invention relates generally to methods and apparatus for producing waveforms of musical tones, voices or other desired sounds on the basis of waveform data read out from a waveform memory or the like, and more particularly to an improved waveform production method and apparatus capable of producing waveforms that are faithfully representative of color (timbre) variations effected by various styles of rendition or articulation peculiar to natural musical instruments. Note that the present invention is applicable extensively to all fields of equipment, apparatus or methods capable of producing waveforms of musical tones, voices or other desired sounds, such as automatic performance apparatus, computers, electronic game apparatus or other types of multimedia equipment, not to mention ordinary electronic musical instruments. It should also be appreciated that in this specification, the term "tone" is used to refer to not only a musical tone but also a voice or other sound, and similarly the terms "tone waveform" are used to embrace a waveform of a voice or any other desired sound, rather than to refer to a waveform of a musical tone alone.

The so-called "waveform memory readout" method has been well known, in which waveform data (i.e., waveform sample data), encoded by a desired encoding technique, such as the PCM (Pulse Code Modulation), DPCM (Differential PCM) or ADPCM (Adaptive Differential PCM), are prestored in a waveform memory so that a tone waveform can be produced by reading out the waveform data from the memory at a rate corresponding to a desired tone pitch. There have been known various types of waveform memory readout techniques. Most of the known waveform memory readout techniques are intended to produce a waveform from the beginning to end of a tone to be generated. Among examples of the known waveform memory readout techniques is one that prestores waveform data of an entire waveform from the beginning to end of a tone to be generated, and one that prestores waveform data of a full waveform section for an attack portion or the like of a tone having complicated variations but prestores predetermined loop waveform segments for a sustain or other portion having little variations. In this specification, the terms "loop waveform" are used to refer to a waveform to be read out in a repeated (looped) fashion.

In these waveform memory readout techniques prestoring waveform data of an entire waveform from the beginning to end of a tone to be generated or waveform data of a full waveform section for an attack portion or the like of a tone, there must be prestored a multiplicity of various waveform data corresponding to a variety of rendition styles (or articulation) and thus a great storage capacity is required for storing the multiplicity of waveform data.

Further, although the above-mentioned technique designed to prestore waveform data of an entire waveform can faithfully express color (timbre) variations effected by various rendition styles or articulation peculiar to a natural musical instrument, it can only reproduce tones just in the same manner as represented by the prestored data, and thus it tends to encounter poor controllability and editability. For example, it has been very difficult for the technique to perform control of waveform characteristics, such as time axis control, according to performance data, of the waveform date corresponding to a desired rendition style or articulation.

To address the above-discussed inconveniences, more sophisticated techniques for facilitating realistic reproduction and control of various rendition styles (or articulation) peculiar to natural musical instruments have been proposed in Japanese Patent Laid-open Publication No. 2000-122665 and the like; these techniques are also known as SAEM (Sound Articulation Element Modeling) techniques. In the case of such SAEM techniques, when a plurality of rendition style waveform modules are to be time-serially connected together to create a continuous tone waveform, it is desired to connect the rendition style waveform modules without unnaturalness.

SUMMARY OF THE INVENTION

In view of the foregoing, it is an object of the present invention to a waveform production method and apparatus which can produce high-quality waveform data corresponding to various rendition styles (or articulation) in an easy and simplified manner and with abundant controllability.

It is another object of the present invention to provide a waveform production method and apparatus which, in producing high-quality waveform data corresponding to various rendition styles (or articulation), can interconnect rendition style modules without unnaturalness.

It is still another object of the present invention to provide a waveform production method and apparatus which facilitate creation of music piece data and can be operated with ease.

According to a first aspect of the present invention, there is provided a waveform production method which comprises: a step of supplying, in accordance with order of time, pieces of performance event information designating rendition style modules; a step of, when a given piece of performance event information at a given time is to be processed in accordance with the pieces of performance event information supplied in accordance with the order of time, obtaining another piece of performance event information related to one or more events, following the given piece of performance event information, in advance of a predetermined original time position of the other piece of performance event information; a step of generating control data corresponding to a rendition style module designated by at least one of the given piece of performance event information and the other piece of performance event information obtained in advance by the step of obtaining, on the basis of the given piece and the other piece of performance event information; and a step of synthesizing waveform data corresponding to the designated rendition style module on the basis of the control data.

The present invention is characterized in that when a given piece of performance event information at a given time point is to be processed in accordance with the pieces of performance event information supplied in accordance with the order of time, another piece of performance event information related to one or more events following the given piece of performance event information is obtained in advance of a predetermined original time position of the other piece of performance event information and then control data corresponding to a rendition style module designated by at least one of the given piece of performance event information and the other piece of performance event information obtained in advance are generated on the basis of the given piece and the other piece of performance event information. This arrangement permits creation of control data taking into consideration relationships between rendition style modules based on successive pieces of performance event information. For example, the present invention thus arranged can apply appropriate processing to the control data such that rendition style waveforms designated by rendition style modules based successive pieces of performance event information can be interconnected smoothly.

According to a second aspect of the present invention, there is provided a waveform production method which comprises: a step of sequentially designating rendition style modules; a step of obtaining trailing end information related to a characteristic of at least a trailing end portion of a preceding rendition style module and leading end information related to a characteristic of at least a leading end portion of a succeeding rendition style module; a step of modifying a characteristic of at least one of the preceding and succeeding rendition style modules on the basis of the obtained trailing end information and leading end information; and a step of synthesizing a waveform corresponding to the designated rendition style module in accordance with the modified characteristic.

The present invention is characterized in that trailing end information related to a characteristic of at least a trailing end portion of a preceding rendition style module and leading end information related to a characteristic of at least a leading end portion of a succeeding rendition style module are obtained by way of a so-called "rehearsal" prior to actual synthesis of a waveform corresponding to the preceding rendition style module. Characteristic of at least one of the preceding and succeeding rendition style modules is modified, in accordance with relationships between the thus-obtained trailing end and leading end information, so that the preceding and succeeding rendition style modules can be interconnected smoothly. The thus-modified characteristic is retained as a parameter or control data. Then, a waveform corresponding to the designated rendition style module is actually synthesized in accordance with the modified characteristic. In this way, rendition style waveforms based on the successive (preceding and succeeding) rendition style modules can be interconnected smoothly.

According to a third aspect of the present invention, there is provided a waveform production method which comprises: a step of supplying rendition style designation information including information designating a rendition style module and parameter information for controlling the rendition style module; a step of, when the supplied rendition style designation information is lacking in necessary parameter information, filling the lacking necessary parameter information with a predetermined standard parameter to thereby supplement the rendition style designation information; and a step of synthesizing waveform data corresponding to the rendition style module designated on the basis of the rendition style designation information including the supplemented rendition style designation information with the predetermined standard parameter information.

The present invention is characterized in that when any supplied rendition style designation information is lacking in parameter information necessary for synthesizing a rendition style waveform corresponding to a rendition style module designated by the designation information, the lacking information is automatically filled with a predetermined standard parameter to supplement the rendition style designation information so that the rendition style waveform corresponding to the designated rendition style module can be synthesized without any inconveniences. For example, if the designated rendition style module is a module of a rendition style waveform having vibrato characteristics, control parameters indicative of a vibrato depth and the like have to be prepared in normal cases. However, even in the case where such necessary parameters are not contained in the rendition style designation information, the parameter filling feature of the present invention arranged as above can synthesize the desired rendition style waveform without any inconveniences. As the predetermined standard parameters to be used, there may be prepared fixed default values corresponding to the parameters for each type of rendition style module. Alternatively, there may be stored, in memory, last-used (most-recently-used) values of the parameters so as to be used as the standard parameters (variable default values). Because the present invention can thus eliminate a need to include all necessary parameters in the rendition style designation information, it can effectively lessen the load and time and labor in creating data of a music piece to be automatically performed.

According to a fourth aspect of the present invention, there is provided a waveform production method which comprises: a step of supplying, in accordance with order of time, pieces of performance event information designating rendition style modules; and a step of generating waveform data corresponding to a rendition style module on the basis of given performance event information, wherein when a waveform including at least attack and body portions is to be synthesized, said step of supplying supplies, as the performance event information, first module event data for designating a waveform of the attack portion, note-on event data and second module event data for designating a waveform of the body portion, and wherein said step of generating initiates generation of the waveform of the attack portion in response to said first module event data supplied before the note-on event data, and initiates generation of the waveform of the body portion in response to said second module event data supplied after the note-on event data.

In the waveform production method according to the fourth aspect, when a waveform including at least body and release portions is to be synthesized, said step of supplying may supply, as the performance event information, third module event data for designating a waveform of the release portion and note-off event data, following said second module event data for designating the waveform of the body portion, and wherein said step of generating initiates generation of the waveform of the release portion in response to said third module event data supplied before the note-off event data, after having generated the waveform of the body portion in response to said second module event data.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which.

DETAILED DESCRIPTION OF THE EMBODIMENTS

[Hardware Setup]

Figure 1:
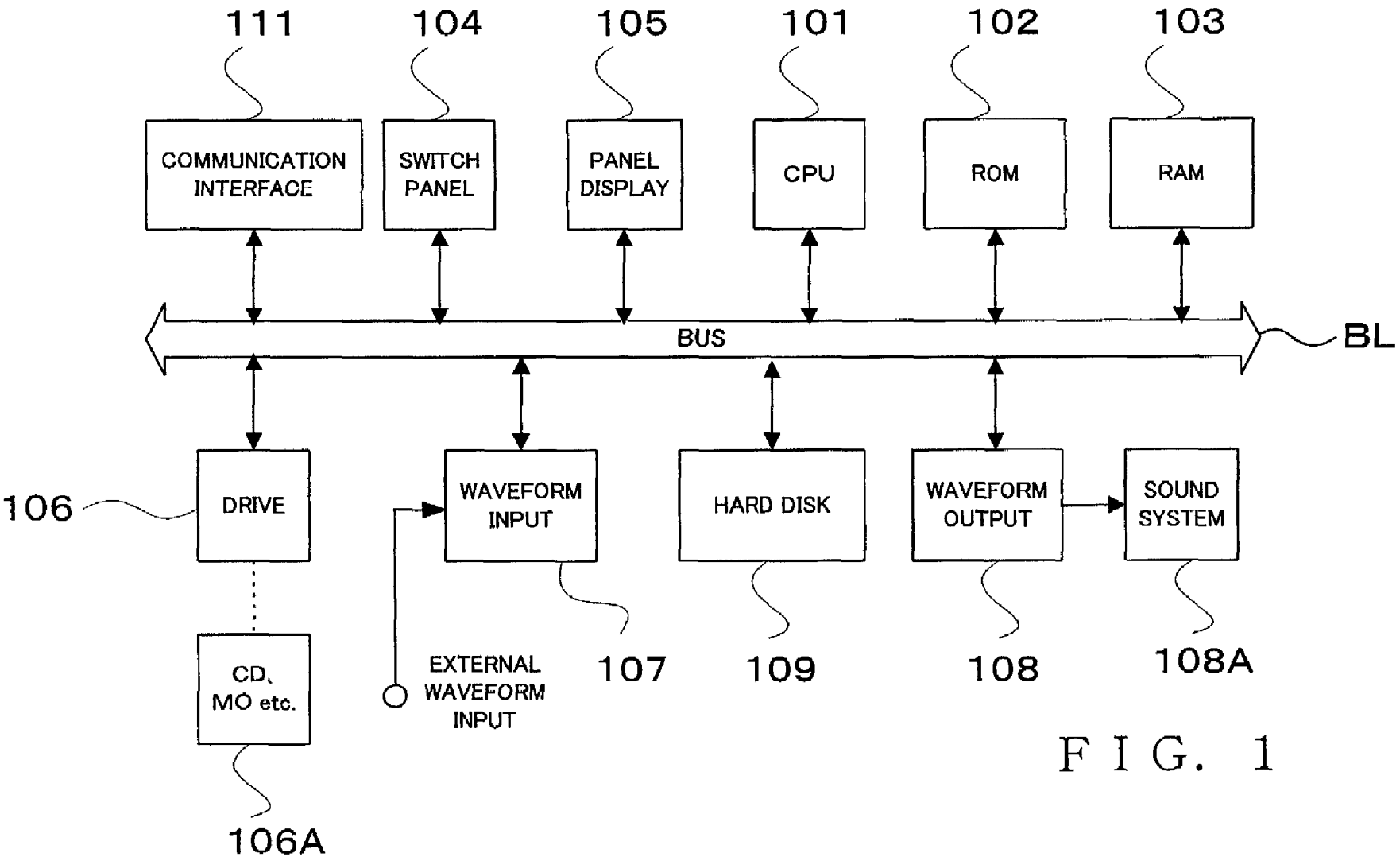
FIG. 1 is a block diagram showing an exemplary hardware organization of a waveform production apparatus in accordance with an embodiment of the present invention.

FIG. 1 is a block diagram showing an exemplary hardware organization of a waveform production apparatus in accordance with an embodiment of the present invention. The waveform production apparatus illustrated here is constructed using a computer, and predetermined waveform producing processing is carried out by the computer executing predetermined waveform producing programs (software). Of course, the waveform producing processing may be implemented by microprograms to be executed by a DSP (Digital Signal Processor), rather than by such computer software. Also, the waveform producing processing of the invention may be implemented by a dedicated hardware apparatus that includes discrete circuits or integrated or large-scale integrated circuit. Further, the waveform production apparatus of the invention may be implemented as an electronic musical instrument, karaoke apparatus, electronic game apparatus, multimedia-related apparatus, personal computer or any other desired form of product.

In FIG. 1, the waveform production apparatus in accordance with the instant embodiment includes a CPU (Central Processing Unit) 101 functioning as a main control section of the computer, to which are connected, via a bus (e.g., data and address bus) BL, a ROM (Read-Only Memory) 102, a RAM (Random Access Memory) 103, a switch panel 104, a panel display unit 105, a drive 106, a waveform input section 107, a waveform output section 108, a hard disk 109 and a communication interface 111. The CPU 101 carries out various processes directed to "rendition style waveform production", "ordinary tone synthesis based on a software tone generator", etc. on the basis of predetermined programs, as will be later described in detail. These programs are supplied, for example, from a network via the communication interface 111 or from an external storage medium 106A, such as a CD or MO (Magneto-Optical disk) mounted in the drive 106, and then stored in the hard disk 109. For execution of a desired one of the programs, the desired program is loaded from the hard disk 109 into the RAM 103; however, the programs may be prestored in the ROM 102.

The ROM 102 stores therein various programs and data to be executed or referred to by the CPU 101. The RAM 103 is used as a working memory for temporarily storing various performance-related information and various data generated as the CPU 101 executes the programs, or as a memory for storing a currently-executed program and data related to the program. Predetermined address regions of the RAM 103 are allocated to various functions and used as various registers, flags, tables, memories, etc. The switch panel 104 includes various operators for entering various setting information, such as performance conditions and waveform producing conditions, editing waveform data etc. and entering various other information. The switch panel 104 may be, for example, in the form of a ten-button keypad for inputting numerical value data, keyboard for inputting character data and/or panel switches. The switch panel 104 may also include other operators for selecting, setting and controlling a pitch, color, effect, etc. of each tone to be generated. The panel display unit 105 comprises a liquid crystal display (LCD), CRT (Cathode Ray Tube) and/or the like for displaying various information entered via the switch panel 104, sampled waveform data, etc.

The waveform input section 107 contains an A/D converter for converting an analog tone signal, introduced via an external waveform input device such as a microphone, into digital data (waveform data sampling), and inputs the thus-sampled digital waveform data into the RAM 103 or hard disk 109 as digital waveform data. Rendition style waveform database can be created on the basis of the above-mentioned input waveform data. Also, waveform data produced through waveform production processing by the CPU 101 are given via the bus BL to the waveform output section 108 and then stored into a buffer thereof as necessary. The waveform output section 108 reads out the buffered waveform data at a predetermined output sampling frequency and then sends the waveform data to a sound system 108A after D/A-converting the data. In this way, each tone signal output from the waveform output section 108 is sounded or audibly reproduced via the sound system 108A. Here, the hard disk 109 is provided to function as a database storing data (various data of a later-described rendition style table, code book, etc.) for synthesizing waveform corresponding to a rendition style, ordinary waveform data, a plurality of types of performance-related data such as tone color data composed of various tone color parameters, and control-related data such as those of various programs to be executed by the CPU 101.

The drive 106 functions to drive a removable disk (external storage medium 106A) for storing data (various data of the later-described rendition style table, code book, etc.) for synthesizing a waveform corresponding to a rendition style, ordinary waveform data, a plurality of types of performance-related data such as tone color data composed of various tone color parameters and control-related data such as those of various programs to be executed by the CPU 101. The external storage medium 106A to be driven by the drive 106 may be any one of various known removable-type media, such as a floppy disk (FD), compact disk (CD-ROM or CD-RAM), magneto-optical (MO) disk or digital versatile disk (DVD). Stored contents (control program) of the external storage medium 106A set in the drive 106 may be loaded directly into the RAM 103, without being first loaded into the hard disk 109. The approach of supplying a desired program via the external storage medium 106A or via a communication network is very advantageous in that it can greatly facilitate version upgrade of the control program, addition of a new control program, etc.

Further, the communication interface 111 is connected to a communication network, such as a LAN (Local Area Network), the Internet or telephone lines, via which it may be connected to a desired sever computer or the like (not shown) so as to input a control program and various data or performance information to the waveform production apparatus. Namely, in a case where a particular control program and various data are not contained in the ROM 102 or hard disk 109 of the waveform production apparatus, these control program and data can be downloaded from the server computer via the communication interface 111 to the waveform production apparatus. In such a case, the waveform production apparatus of the invention, which is a "client", sends a command to request the server computer to download the control program and various data by way of the communication interface 111 and communication network. In response to the command from the client, the server computer delivers the requested control program and data to the waveform production apparatus via the communication network. The waveform production apparatus receives the control program and data from the server computer via the communication network and communication interface 111 and accumulatively stores them into the hard disk 109. In this way, the necessary downloading of the control program and various data is completed. It should be obvious that the waveform production apparatus may further includes a MIDI interface so as to receive MIDI performance information. It should also be obvious that a music-performing keyboard and music operating equipment may be connected to the bus BL so that performance information can be supplied to the waveform production apparatus by an actual real-time performance. Of course, the external storage medium 106A containing performance information of a desired music piece may be used to supply the performance information of the desired music piece.

[Outline of Rendition Style Module]

In the rendition style waveform database constructed using the above-mentioned hard disk 109 or other suitable storage medium, there are stored a multiplicity of module data sets (hereinafter called "rendition style modules") for reproducing waveforms corresponding to elements of various rendition styles (i.e., various articulation), as well as data groups pertaining to the rendition style modules. Each of the rendition style modules is a rendition style waveform unit that can be processed as a single block in a rendition style waveform synthesis system; in other words, the rendition style module is a rendition style waveform unit that can be processed as a single event. In the instant embodiment, the rendition style modules include those defined in accordance with characteristics of a rendition style of a performance tone, those defined in correspondence with a partial section of a tone such as an attack, body or release portion, those defined in correspondence with a joint section between successive tones such as a slur, those defined in correspondence with a special performance section of a tone such as a vibrato, and those defined in correspondence with a plurality of notes like a phrase.

The rendition style modules can be classified into several major types on the basis of characteristics of rendition styles, timewise segments or sections of a performance, or the like. For example, five major types of the rendition style modules in the instant embodiment are:

1) "Normal Entrance" (abbreviated "NE"): Rendition style module representative of a rise portion (i.e., attack portion) of a tone from a silent state;
2) "Normal Finish" (abbreviated "NF"): Rendition style module representative of a fall portion (i.e., release portion) of a tone leading to a silent state;
3) "Normal Joint" (abbreviated "NJ"): Rendition style module representative of a joint portion interconnecting two successive tones with no intervening silent state;
4) "Normal Short Body" (abbreviated "NSB"): Rendition style module representative of a short non-vibrato-imparted portion of a tone in between the rise and fall portions (i.e., non-vibrato-imparted body portion of the tone); and
5) "Vibrato Long Body" (abbreviated "VLB"): Rendition style module representative of a vibrato-imparted portion of a tone in between the rise and fall portions (i.e., vibrato-imparted body portion of the tone).

The classification into the above five module types is just illustrative, and the classification of the rendition style modules may be made in any other suitable manner; for example, the rendition style modules may be classified into more than five types. Further, the rendition style modules may also be classified according to original tone sources, such as musical instruments.

In the instant embodiment, the data of each rendition style waveform corresponding to a single rendition style module are stored in the database as data of a group of a plurality of waveform-constituting factors or elements; each of the waveform-constituting elements will hereinafter be called a vector. As an example, the rendition style module includes the following vectors. Note that "harmonic" and "nonharmonic" components are defined here by separating an original rendition style waveform in question into a waveform segment having a pitch-harmonious component (harmonic component) and the remaining waveform segment having a non-pitch-harmonious component (nonharmonic component).

1) Waveform shape (timbre) vector of the harmonic component: This vector represents only a characteristic of a waveform shape extracted from among the various waveform-constituting elements of the harmonic component and normalized in pitch and amplitude.
2) Amplitude vector of the harmonic component: This vector represents a characteristic of an amplitude envelope waveform extracted from among the waveform-constituting elements of the harmonic component.

3) Pitch vector of the harmonic component: This vector represents a characteristic of a pitch extracted from among the waveform-constituting elements of the harmonic component; for example, it represents a time-wise pitch fluctuation characteristic relative to a given reference pitch.

4) Waveform shape (timbre) vector of the nonharmonic component: This vector represents only a characteristic of a waveform shape (noise-like waveform shape) with normalized amplitude extracted from among the waveform-constituting elements of the nonharmonic component.

5) Amplitude vector of the nonharmonic component: This vector represents a characteristic of an amplitude envelope extracted from among the waveform-constituting elements of the nonharmonic component.

The rendition style module may include one or more other types of vectors, such as one indicative of a time-axial progression of the waveform, although not specifically described here.

For synthesis of a rendition style waveform, waveforms or envelopes corresponding to various constituent elements of the rendition style waveform are constructed along a reproduction time axis of a performance tone by applying appropriate processing to these vector data in accordance with control data and placing the thus-processed vector data on the time axis and then carrying out a predetermined waveform synthesis process on the basis of the vector data placed on the time axis. For example, to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Figure 2:
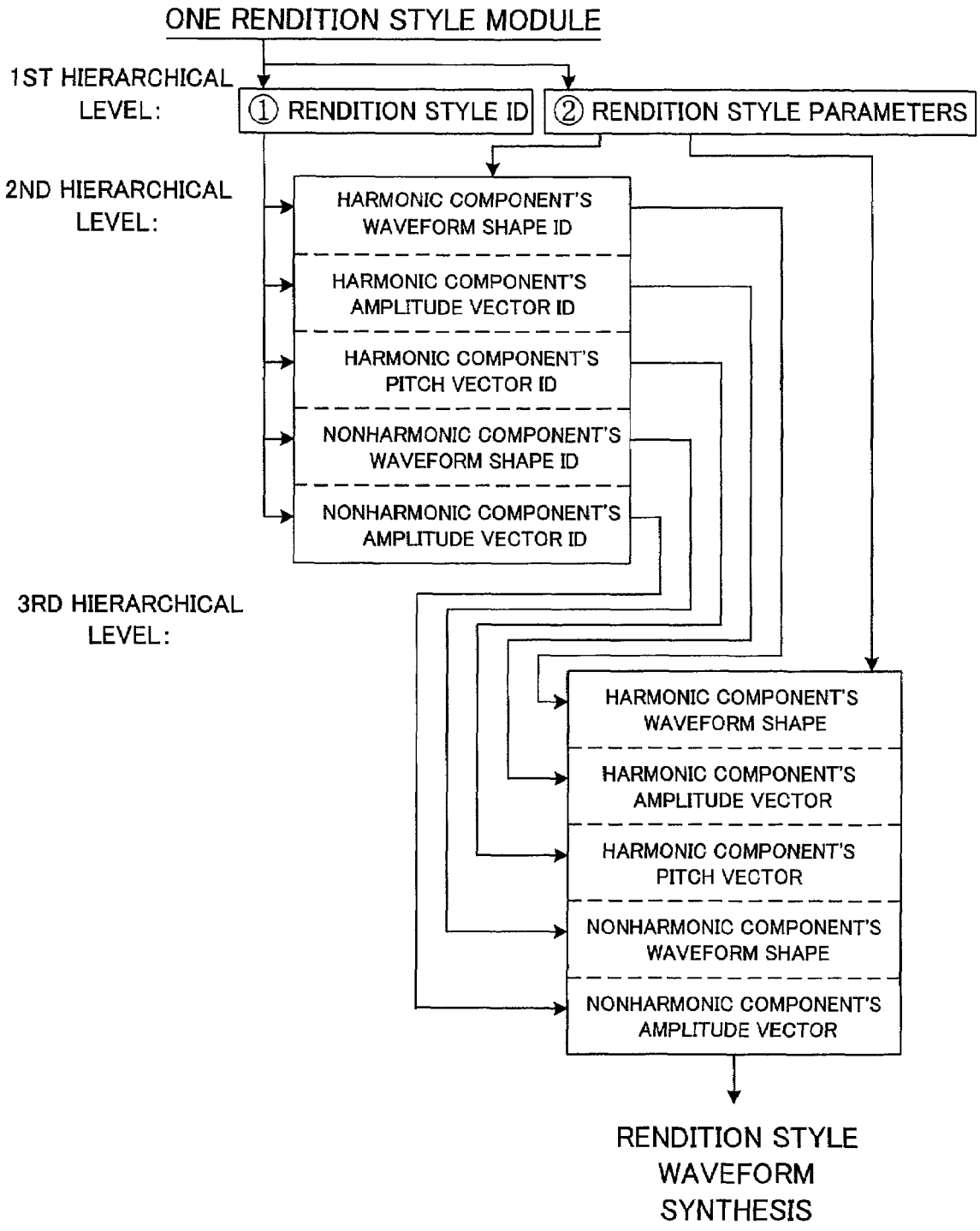
FIG. 2 is a diagram explanatory of an exemplary data format of a rendition style module.

This and following paragraphs describe an exemplary data format of the rendition style modules, with reference to FIG. 2. As an example, each rendition style module can be identified or specified via a hierarchical data organization as shown in FIG. 2. At a first hierarchical level, a rendition style module is specified by a combination of "rendition style ID (identification information)" and "rendition style parameters". The "rendition style ID" is information uniquely identifying the rendition style module and can function as one piece of information for reading out necessary vector data from the database. The "rendition style IDs" at the first hierarchical level can be classified, for example, according to combinations of "musical instrument information" and "module part name". Each piece of the "musical instrument information" represents the name of a musical instrument to which the rendition style module is applied, such as a violin, alto saxophone or piano. The "module part name" is information indicative of the type and character, such as "normal entrance" or "bend entrance", of the rendition style module. Such "musical instrument information" and "module part name" may be included in the "rendition style ID". Alternatively, the "musical instrument information" and "module part name" may be added to the "rendition style ID" in such a manner that a user is allowed to know, from the "musical instrument information" and "module part name", the character of the rendition style module to which the rendition style ID" pertains.

The "rendition style parameters" are intended to control a time length and level of the waveform represented by the rendition style module, and they may include one or more types of parameters differing from each other depending on the character of the rendition style module. For example, in the case of a given rendition style module specifiable by a combination of musical instrument information and module part name "Violin[NormalEntrance]", the rendition style parameters may include different types of parameters, such as an absolute tone pitch and volume immediately after Entrance or attack. In the case of another rendition style module specifiable by a combination of musical instrument information and module part name "Violin[BendupEntrance]", the rendition style parameters may include different types of parameters, such as an absolute tone pitch at the end of BendUpEntrance, initial bend depth value at the time of BendUpEntrance, time length from the beginning (note-on timing) to end of BendUpEntrance, tone volume immediately after Entrance, and/or timewise stretch/contraction of a default curve during BendUpEntrance. In the case of another rendition style module specifiable by a combination of musical instrument information and module part name "Violin[NormalShortBody]", the rendition style parameters may include different types of parameters, such as an absolute tone pitch of the module, start and end times (i.e., end time—start time) of NormalShortBody, dynamics at the beginning of NormalShortBody, and dynamics at the end of NormalShortBody. The "rendition style parameters" may be prestored in memory or the like along with the corresponding rendition style IDs or entered by user's input operation, or existing parameters may be modified via user operation to thereby provide the rendition style parameters. Further, in a situation where only the rendition style ID has been supplied with no rendition style parameter at the time of reproduction of a rendition style waveform, standard rendition style parameters for the supplied rendition style ID may be automatically imparted. Furthermore, suitable parameters may be automatically imparted in the course of processing.

The data at the second hierarchical level of FIG. 2 comprise data of vector IDs each specifiable by the rendition style ID. The data of vector IDs may be specified by not only the rendition style ID but also the rendition style parameter. The rendition style database includes a rendition style table or memory. In the rendition style table, there are prestored, in association with the rendition style IDs, identification information (i.e., vector IDs) of a plurality of waveform-constituting elements, i.e. vectors, for constructing the rendition style modules represented by the respective rendition style IDs. Namely, data of desired vector IDs and the like can be obtained by reading the rendition style table in accordance with the rendition style ID. Also, the data of desired vector IDs and the like may be obtained from the redition style table in accordance with the rendition style ID and the rendition style parameter. Note that the data of the second hierarchical level stored in the rendition style table may include other necessary data in addition to the data of the vector IDs. The rendition style table may include, as the other necessary data, data indicative of numbers of representative sample points to be modified in a train of samples (hereinafter called a "train of representative sample point numbers"). For example, because data of an envelope waveform shape, such as amplitude vector and pitch vector data, can reproduce the waveform shape if only they contain data of several representative sample points, it is not necessary to prestore all data of the envelope waveform shape as a template, and it suffices to prestore only the data of the train of representative sample point numbers. Hereinafter, the data of the train of representative sample point numbers will also be called "Shape" data. The rendition style table may further include information, such as start and end time positions of the vector data of the individual waveform-constituting elements, i.e. waveform shape, pitch (pitch envelope) and amplitude (amplitude envelope). All or some of the data of the time positions and the like may be included in the above-mentioned rendition style parameters; stated differently, some kinds of the rendition style parameters may be stored in the rendition style table along with the corresponding rendition style ID. The some kinds of the rendition style parameters stored in the rendition style table along with the corresponding rendition style ID may be changed or controlled by other rendition style parameters given at the first hierarchical level.

The data at the third hierarchical level of FIG. 2 comprise vector data specifiable by the corresponding vector IDs. The rendition style database includes a memory called a "code book", in which specific vector data (e.g., templates of Timbre waveform shapes) are prestored in association with the vector IDs. Namely, specific vector data can be read out from the code book in accordance with the vector ID.

The following describe an example of various specific data, including the vector ID and Shape (train of representative sample point numbers) data of the rendition style module prestored in the rendition style:

Data 1: Sampled length of the rendition style module;

Data 2: Position of note-on timing;

Data 3: Vector ID of the amplitude element of the harmonic component and train of representative sample point numbers;

Data 4: Vector ID of the pitch element of the harmonic component and train of representative sample point numbers;

Data 5: Vector ID of the waveform shape (Timbre) element of the harmonic component;

Data 6: Vector ID of the amplitude element of the nonharmonic component and train of representative sample point numbers;

Data 7: Vector ID of the waveform shape (Timbre) element of the nonharmonic component;

Data 8: Start position of a waveform block of the waveform shape (Timbre) element of the harmonic component;

Data 9: End position of a waveform block (i.e., start position of a loop portion) of the waveform shape (Timbre) element of the harmonic component;

Data 10: Start position of a waveform block of the waveform shape (Timbre) element of the nonharmonic component;

Data 11: End position of a waveform block (i.e., start position of a loop portion) of the waveform shape (Timbre) element of the nonharmonic component; and Data 12: End position of the loop portion of the waveform shape (Timbre) element of the nonharmonic component.

Data 1-Data 12 mentioned above will be described below in greater detail with reference to FIG. 3.

Figure 3:
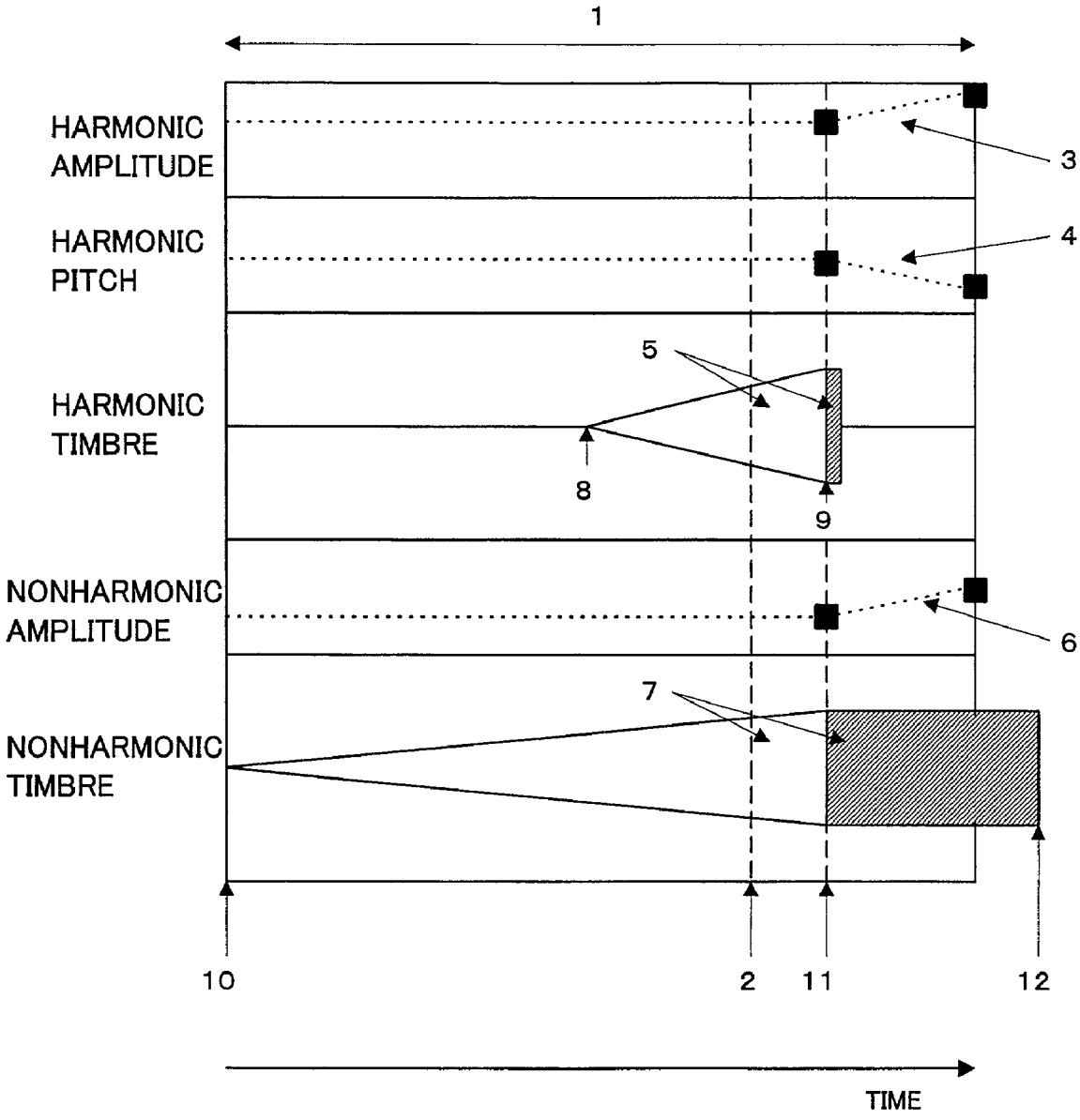
FIG. 3 is a diagram schematically illustrating various waveform components and elements constituting an actual waveform section corresponding to a given rendition style module.

FIG. 3 is a diagram schematically illustrating various waveform components and elements constituting an actual waveform section corresponding to the rendition style module in question. From the top to bottom of FIG. 3, there are shown the amplitude element, pitch element and waveform shape (Timbre) element of the harmonic component, and the amplitude element and waveform shape (Timbre) element of the nonharmonic component which have been detected in the waveform section. Note that numeral values in the figure correspond to the above-mentioned data (Data 1-Data 12).

More specifically, numerical value "1" represents the sampled length of the waveform section (length of the waveform section) corresponding to the rendition style module, which corresponds, for example, to the total time length of the original waveform data from which the rendition style module in question is derived. Numerical value "2" represents the position of the note-on timing, which can be variably set at any time position of the rendition style module. Although, in principle, sounding of the performance tone based on the waveform is initiated at the position of the note-on timing, the rise start point of the waveform component may precede the note-on timing depending on the nature of a particular rendition style such as a bend attack. For instance, in the case of a violin, rubbing, by a bow, of a string is initiated prior to actual sounding, this data is suitable for accurately simulating a beginning portion of the rendition style waveform prior to the actual sounding. Numerical value "3" represents the vector ID designating the vector data of the amplitude element of the harmonic component ("Harmonic Amplitude") and train of representative sample point numbers stored in the code book; in the figure, two square marks filled in with black indicate these representative sample points. Numerical value "4" represents the vector ID designating the vector data of the pitch element of the harmonic component ("Harmonic Pitch") and train of the representative sample point numbers.

Numerical value "6" represents the vector ID designating the vector data of the amplitude element of the nonharmonic component ("Nonharmonic Amplitude") and train of representative sample point numbers. The representative sample point numbers are data to be used for changing/controlling the vector data designated by the vector ID, and designates some of the representative sample points. As the respective time positions (plotted on the horizontal axis of the figure) and levels (plotted on the vertical axis of the figure) for the designated representative sample points are changed or controlled, the other sample points are also changed so that the overall shape of the vector can be changed. For example, the representative sample point numbers represent discrete samples fewer than the total number of the samples; however, the representative sample point numbers may be values at intermediate points between the samples, or values at a plurality of successive samples over a predetermined range. Alternatively, the representative sample point numbers may be such values indicative of differences between the sample values, multipliers to be applied to the sample values or the like, rather than the sample values themselves. The shape of each vector data, i.e. shape of the envelope waveform, can be changed by moving the representative sample points along the horizontal axis (time axis) and/or vertical axis (level axis). Numerical value "5" represents the vector ID designating the vector data of the waveform shape (Timbre) element of the harmonic component ("Harmonic Timbre").

Further, in FIG. 3, numerical value "7" represents the vector ID designating the vector data of the waveform shape (Timbre) element of the nonharmonic component ("Nonharmonic Timbre"). Numerical value "8" represents the start position of the waveform block of the waveform shape (Timbre) element of the harmonic component. Numerical value "9" represents the end position of the waveform block of the waveform shape (Timbre) element of the harmonic component (i.e., the start position of the loop portion of the waveform shape (Timbre) element of the harmonic component). Namely, the triangle starting at a point denoted by "8" represents a nonloop waveform segment where characteristic waveform shapes are stored in succession, and the following rectangle starting at a point denoted by "9" represents a loop waveform segment that can be read out in a repeated fashion. The nonloop waveform segment represents a high-quality waveform segment that is characteristic of the rendition style (articulation) etc., while the loop waveform segment represents a unit waveform of a relatively monotonous tone segment having a single or an appropriate plurality of wave cycles.

Numerical value "10" represents the start position of the waveform block of the waveform shape (Timbre) element of the nonharmonic component. Numerical value "11" represents the end position of the waveform block of the waveform shape (Timbre) element of the nonharmonic component (i.e., the start position of the loop portion of the waveform shape (Timbre) element of the nonharmonic component). Further, numerical value "12" represents the end position of the loop waveform segment of the waveform shape (Timbre) element of the nonharmonic component. Data 3-Data 7 are ID data indicating the vector data stored in the code book in association with the individual waveform elements, and Data 2 and Data 8-Data 12 are time data for restoring the original waveform (i.e., the waveform before the waveform separation or segmentation) on the basis of the vector data. Namely, the data of each of the rendition style modules comprise the data designating the vector data and time data. Using such rendition style module data stored in the rendition style table and the waveform producing materials (i.e., vector data) stored in the code book, any desired waveform can be constructed freely. Namely, each of the rendition style modules comprises data representing behavior of a waveform to be produced in accordance with a rendition style or articulation. Note that the rendition style modules may differ from each other in the type and total number of the data included therein and may include other data in addition to the above-mentioned data. For example, the rendition style modules may include data to be used for controlling the time axis of the waveform for stretch/contraction thereof (time-axial stretch/compression control).

Whereas the preceding paragraphs have described the case where each of the rendition style modules includes all of the fundamental waveform-constituting elements (waveform shape, pitch and amplitude elements) of the harmonic component and the fundamental waveform constituting elements (waveform shape and amplitude elements) of the nonharmonic component, the present invention is not so limited, and each or some of the rendition style modules may, of course, include only one of the waveform-constituting elements (waveform shape, pitch and amplitude) of the harmonic component and the waveform-constituting elements (waveform shape and amplitude) of the nonharmonic component. For example, each or some of the rendition style modules may include a selected one of the waveform shape, pitch and amplitude elements of the harmonic component and waveform shape and amplitude elements of the nonharmonic component. In this way, the rendition style modules can be used freely in a combination for each of the waveform components, which is very preferable.

[Performance Data]

In the instant embodiment, a set of automatic performance data (music piece file) of a desired music piece includes performance event data for reproducing rendition style waveforms, so that the rendition style waveforms are produced on the basis of the performance event data read out in accordance with a progression of an automatic performance sequence. Each automatic performance data (music piece file) in this embodiment is basically in the SMF (Standard MIDI File) format, and comprises a mixture of ordinary MIDI data and AEM (Articulation Element Modeling) performance data. For example, the automatic performance data set of a music piece comprises performance data of a plurality of tracks, and one or more of these tracks are allocated for an AEM performance sequence containing AEM performance events (rendition style events) while the remaining tracks are allocated for an ordinary MIDI performance sequence. However, MIDI data and AEM performance event (rendition style event) data may be mixedly included in a single track, in which case, basically, the AEM performance event (rendition style event) data are described in the MIDI format and one or more of the MIDI channels are allocated for the AEM performance data. Further, even in the case where an entire track is allocated for the AEM performance data, the data may be described in the MIDI format in principle. Namely, identifiers indicative of AEM performance events (rendition style events) may be added to the data described in the MIDI format. Of course, any other suitable data format than the MIDI format may be employed in the instant embodiment. The performance data of each of the tracks comprise performance data of different performance parts. Further, because the performance data of a plurality of MIDI channels can be mixedly present in the performance data of a single track, even the performance data of a single track can constitute performance data of different performance parts for each MIDI channel. For example, performance tones of one or more performance parts are reproduced by rendition style waveform synthesis based on the AEM performance data. As an example, rendition style waveforms can be synthesized separately, on the basis of the AEM performance data, for a plurality of performance parts, such as violin and piano parts.

Figure 4A:
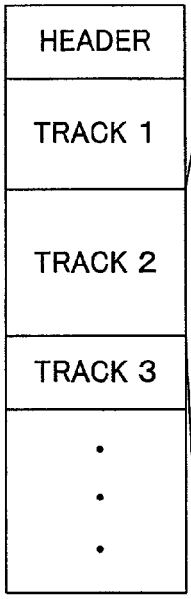
FIGS. 4A and 4B are diagrams explanatory of an exemplary general organization of an automatic performance data set (file) of a given music piece.
Figure 4B:
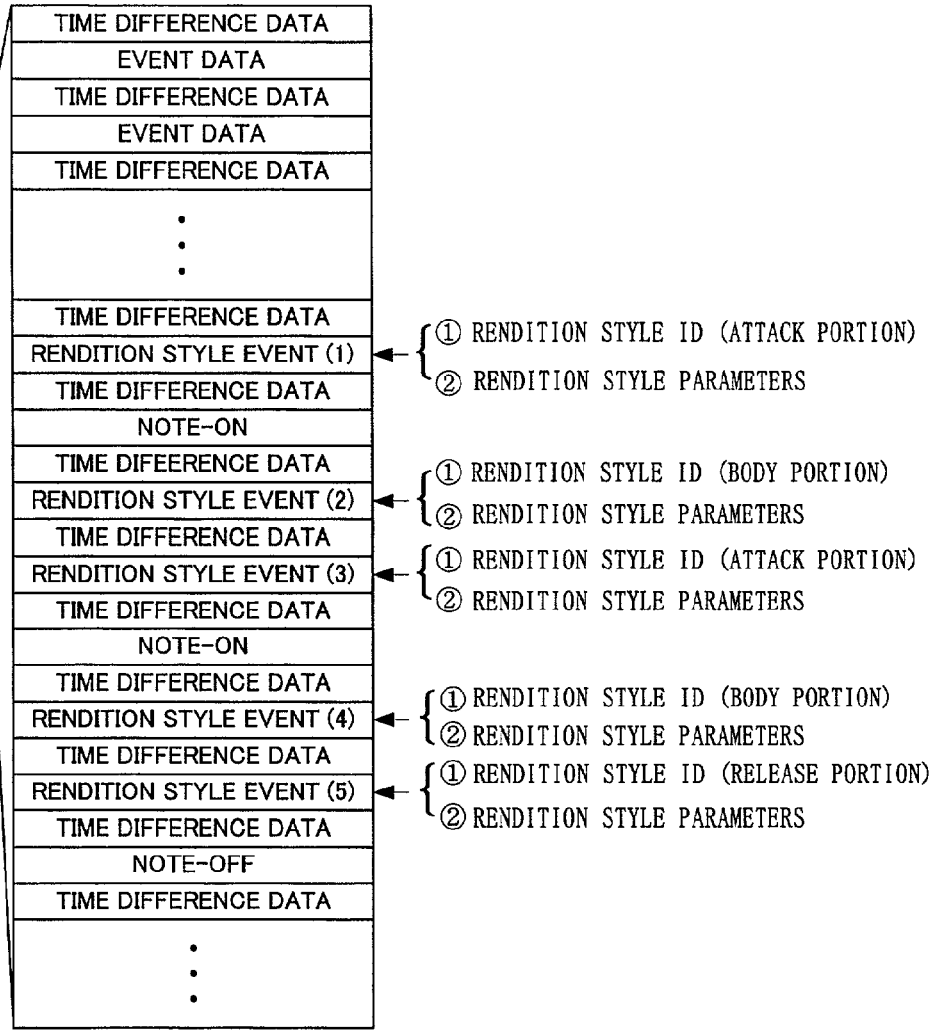

FIG. 4A shows an exemplary general organization of an automatic performance data set of a music piece, which includes a header and performance data trains of tracks 1, 2, 3, . . . FIG. 4B shows an example of a performance data train of one of the tracks (e.g., track 2) including AEM performance data. Similarly to the well-known structure of ordinary performance sequence data, the performance data train of FIG. 4B comprises combinations of time difference data (duration data) and event data. As also well known, each of the time difference data (duration data) represents a time difference between an occurrence time point of a given event and an occurrence time point of a next event.

Each rendition style event data in FIG. 4B includes the data of the first hierarchical level shown in FIG. 2, i.e. "rendition style ID" indicative of a rendition style module to be reproduced in response to the rendition style event and rendition style parameters related thereto. As set forth above, all of the rendition style parameters need not necessarily be in the rendition style event data.

In the illustrated example of FIG. 4B, "rendition style event (1)" includes a rendition style ID indicative of a rendition style module of an attack (i.e., entrance) portion, and "note-on event" data instructing a tone generation start is stored in paired relation to "rendition style event (1)". Tone generation start point of the rendition style waveform of the attack (i.e., entrance) portion instructed by "rendition style event (1)" is designated by the "note-on event" data given in paired relation to "rendition style event (1)". Namely, for the attack portion, "rendition style event (1)" and corresponding "note-on event" are processed together. Thus, the arrival or occurrence time of "rendition style event (1)" corresponding to the attack (i.e., entrance) portion only indicates that preparations should now be initiated for producing the rendition style waveform of the attack (i.e., entrance) portion; it never indicates the tone generation start time. As will be later described, production of the rendition style waveform of the attack (i.e., entrance) portion can be initiated here prior to the start of generation of the corresponding tone, and thus the tone generation can be initiated at an enroute point corresponding to the occurrence time point of the note-on event, not from the beginning of the produced rendition style waveform of the attack (i.e., entrance) portion. Such an arrangement is helpful in simulating a situation where, at the beginning of human player's performance operation (e.g., at the beginning of rubbing, by a bow, of a string of a violin), vibrations responsive to the performance operation are not instantly produced as a vibrating sound audible by the human hearing. In other situations as well, the arrangement can help to enhance flexibility and controllability of waveform production.

Further, in the illustrated example of FIG. 4B, "rendition style event (2)" includes a rendition style ID indicative of a rendition style module of a body portion, "rendition style event (3)" includes a rendition style ID indicative of a rendition style module of a joint portion, and "rendition style event (4)" includes a rendition style ID indicative of a rendition style module of another body portion. The rendition style module of the joint portion represents a connecting rendition style waveform that is used for connection from a preceding tone to a succeeding tone without silencing the preceding tone, e.g. in a rendition style such as a tie or slur. Thus, similarly to "rendition style event (1)" of the attack portion described above, "note-on event" data instructing tone generation start timing of the succeeding tone is given in paired relation to "rendition style event (3)"; namely, the "note-on event" occurs immediately following "rendition style event (3)". "rendition style event (3)" of the joint portion and corresponding "note-on event" are processed together. "rendition style event (4)" indicates a rendition style module of a body portion of the succeeding tone connected with the preceding tone via the above-mentioned joint portion. "rendition style event (5)" includes a rendition style ID indicative of a rendition style module of a release (finish) portion, and "note-off event" data instructing a start of tone deadening (release) is stored in paired relation to "rendition style event (5)". "rendition style event (5)" of the release portion and corresponding "note-off event" are processed together. Similarly to the note-on event, production of the rendition style waveform of the release (i.e., finish) portion is initiated in the instant embodiment prior to the start of deadening (note-off event) of the corresponding tone, so that the tone deadening can be initiated at an enroute point corresponding to the occurrence time point of the note-off event, not from the beginning of the produced rendition style waveform of the release (finish) portion, for the same reasons as stated above in relation to the note-on event. Such an arrangement is helpful in simulating a situation when performance operation on some musical instrument is terminated. In other situations as well, the arrangement can help to enhance flexibility and controllability of waveform production.

[Rendition Style Waveform Production Processing]

Figure 5:
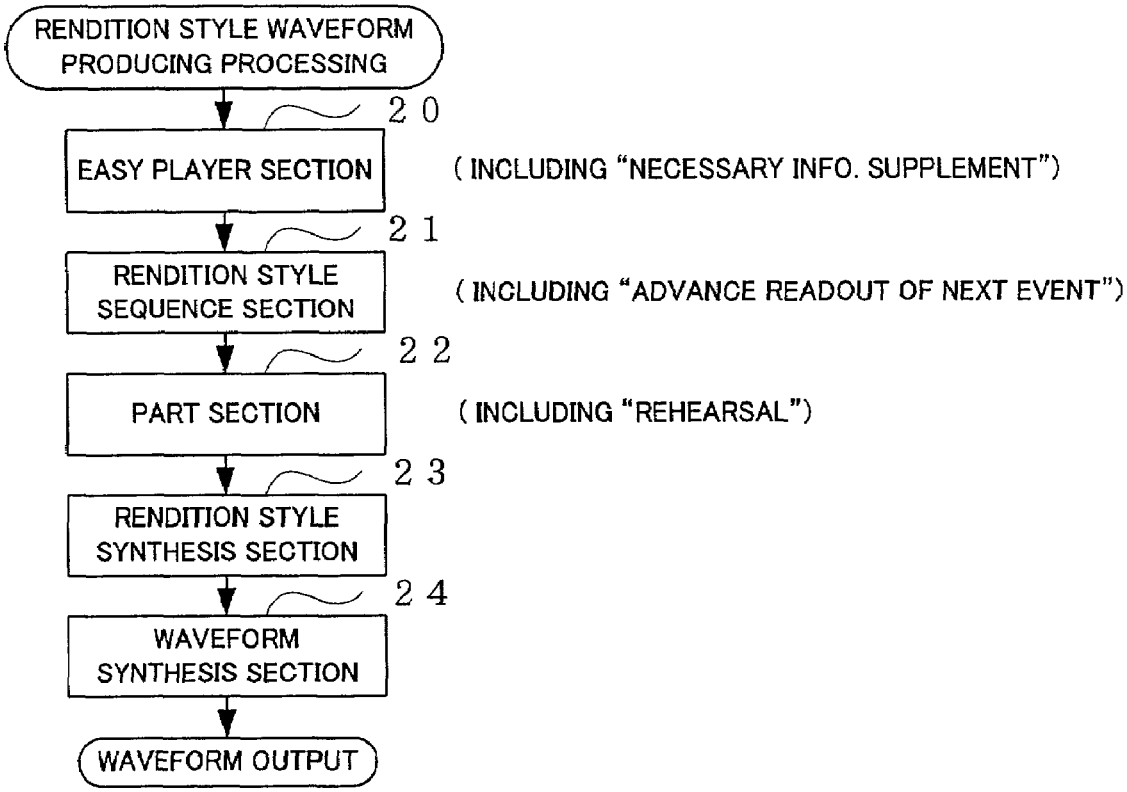
FIG. 5 is a flow chart showing a rough step sequence of rendition style waveform producing processing performed in the embodiment of FIG. 1.
Figure 6:
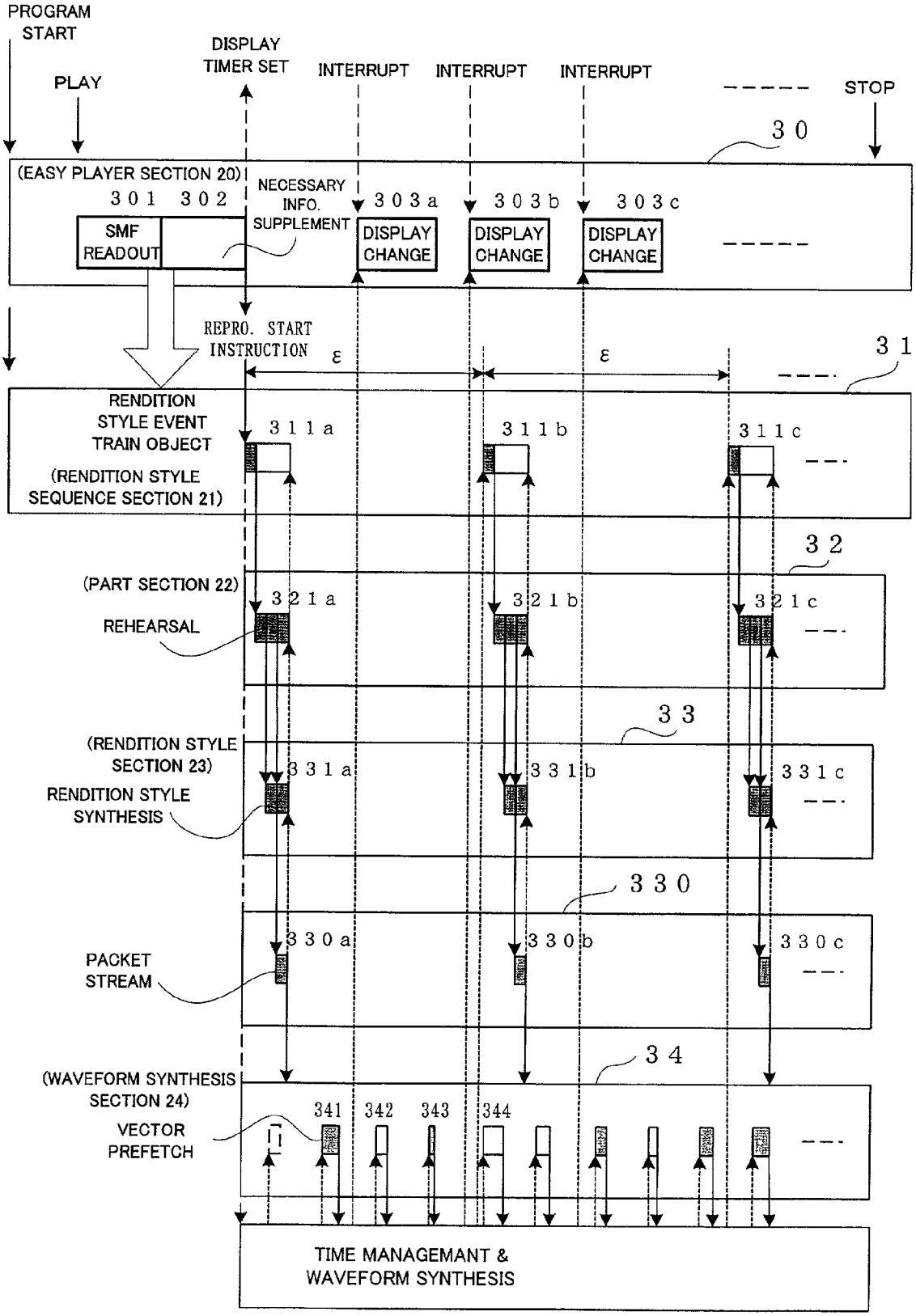
FIG. 6 is a schematic timing chart roughly showing general relationships among various operations carried out by various processing blocks constituting the rendition style waveform producing processing in the embodiment.

The waveform production apparatus of FIG. 1 synthesizes an ordinary tone waveform and rendition style waveform by a computer executing an ordinary tone generator program, predetermined program for rendition style waveform producing processing, etc. As schematically shown in FIG. 5, the rendition style waveform producing processing generally comprises an easy player section 20, a rendition style sequence section 21, a performance part section 22, a rendition style synthesis section 23 and a waveform synthesis section 24. FIG. 6 is a schematic timing chart showing general timewise relationships among various operations carried out by the above-mentioned processing blocks or sections 20 to 24 constituting the rendition style waveform producing processing. Blocks 30, 31, 32, 33 and 34 denoted in parallel in FIG. 6 roughly indicate time zones in which the easy player section 20, rendition style sequence section 21, performance part section 22, rendition style synthesis section 23 and waveform synthesis section 24 perform their respective assigned operations. The reason why blocks 30, 31, 32, 33 and 34 are denoted in parallel in FIG. 6 is to indicate that the operations of the sections 20, 21, 22, 23 and 24 are performed in a parallel fashion.

(1) Easy Player Section 20:

The easy player section 20 performs: a function of reading out a set of automatic performance data (music piece file) of a desired music piece to be reproduced from a storage medium containing such an automatic performance data set; a function of accepting various setting operation (e.g., transposition amount setting operation, tone volume adjusting operation and the like) and instructing operation (e.g., reproduction start instruction, reproduction stop instruction and the like), pertaining to the desired music piece and the like, performed via input operators; a function of controlling various displays including a display of a currently reproduced position (time); a function of filling necessary information; and others.

Time block 30 of FIG. 6 illustrates the time zone in which the easy player section 20 executes its assigned operations. The easy player section 20 operates from a time when an automatic-performance reproducing program is started up to a time when the automatic-performance reproducing program is brought to an end. When a reproduction start instruction PLAY is given, the easy player section 20 reads out a set of automatic performance data (music piece file) of a desired music piece to be reproduced from the storage medium and then interpreting the read-out automatic performance data, at timing of the time zone 301. Of course, the readout of the automatic performance data (music piece file) may be initiated upon selection of the desired music piece prior to receipt of the reproduction start instruction PLAY.

The easy player section 20 is constructed to be able to handle automatic performance data having ordinary MIDI data and AEM performance data mixedly stored on a single track or across a plurality of tracks in the manner as described earlier. Further, the easy player section 20 carries out basic interpretation operations on the AEM performance data included in the read-out automatic performance data (music piece file) and reconstruct the individual rendition style event data as a rendition style event train object imparted with time stamps. The "basic interpretation operations" include, for example, accumulating the time differences between the events to create time stamps for the individual events (a series of absolute time information for the music piece) on the basis of the time differences. The reconstructed rendition style event train object with such time stamps is sent to the rendition style sequence section 21

(i.e., written into a memory associated with the sequence section 21). The performance data interpretation and reconstruction of the rendition style event train object are completed before the time zones 301 and 302 of FIG. 6 end.

To put it briefly, the easy player section 20 functions to convert the AEM performance data (as illustratively shown in FIG. 4), similar in construction to existing automatic performance data, into a data train that can be readily handled by the rendition style sequence section 21. Note that the ordinary MIDI performance data are processed via a known MIDI performance sequencer (MIDI player) provided in the easy player section 20; however, the processing of the ordinary MIDI performance data is not specifically described here because it is a well-known technique. Further, while the rendition style waveform producing processing based on the AEM performance data entails considerable time delays, the processing, by the MIDI player, of the ordinary MIDI performance data causes no substantial time delays. Therefore, the instant embodiment is arranged to compulsorily delay the processing, by the MIDI player, of the ordinary MIDI performance data in accordance with a delay time in the rendition style waveform producing processing based on the AEM performance data and thereby achieve accurate synchronism between two tones generated by the processing of the ordinary MIDI performance data and the processing of the AEM performance data.

Function to Fill Omitted Necessary Information:

If a necessary rendition style parameter is omitted from the AEM performance event data (rendition style event data) of the read-out automatic performance data (music piece file), the easy player section 20 performs another function of filling the omitted parameter to thereby supplement the AEM performance event data. For example, in the case where the ID of a given rendition style event is "Vibrato Long Body" and if a control parameter instructing, for example, a vibrato depth has not been set, there would be caused the inconvenience that the user can not know a degree of vibrato with which to synthesize a rendition style waveform. Thus, depending on the type of rendition style modules, the rendition style event has to have added thereto not only the rendition style ID but also such a necessary parameter. Thus, the easy player section 20 checks to see whether each rendition style event data includes such a necessary parameter, and if not included, it automatically adds the necessary parameter. This information supplementing function is carried out at timing of the time zone 302. The rendition style event train object sent from the easy player section 20 to the rendition style sequence section 21 includes such an added parameter. As one exemplary way of automatically filling the lacking necessary parameter, predetermined default (standard) values of various parameters may be prestored for each type of rendition style module so that one of the default values corresponding to the rendition style event in question can be used to fill the necessary parameter. As one exemplary way of determining the default values, predetermined fixed default values of the various parameters may be prepared in advance, or last-used (most-recently-used) values of the various parameters may be buffered, so that the predetermined fixed default values or buffered last-used values can be determined and used as the default values; of course, the default values may be determined in any other suitable manner.

Predetermined times are previously reserved as the time zones 301 and 302 to be used by the easy player section 20; namely, in response to the reproduction start instruction PLAY, the readout of the SMF automatic performance data and necessary information supplement are performed within the time zones 301 and 302. Although not specifically described here, the user can set various processing time information to be used in the rendition style waveform producing processing and perform various other setting operation, before giving the reproduction start instruction PLAY. The easy player section 20 gives the sequence reproduction start instruction to the rendition style sequence section 21 at the end of the time zone 302. After an actual reproductive performance is initiated in response to the reproduction start instruction, the easy player section 20 receives, from the waveform synthesis section 24, information indicative of a changing current time point of the reproductive performance (i.e., changing current reproduced position), and displays the current time of the reproductive performance. Small blocks 303*a*, 303*b*, 303*c*, . . . in FIG. 6 represent timing of a display change process carried out as a periodic interrupt process for periodically displaying the changing current time of the reproductive performance.

(2) Rendition Style Sequence Section 21:

The rendition style sequence section 21 buffers the rendition style event train object (namely, rendition style event data train) with the time stamps, and it sequentially reads out the rendition style event data in accordance with the reproducing times indicated by the time stamps. The sequential readout of the rendition style event data is carried out as batch processing that is executed every time period corresponding to a desired "output frequency". FIG. 6 illustratively shows a succession of the time periods Part Management:

Since the rendition style waveform synthesis is performed for different performance parts in a parallel fashion, a first task of the rendition style sequence section 21 is to check, prior to receipt of the sequence reproduction start instruction, how many AEM performance parts are present in the current music piece performance, and instruct the performance part section 22 to set a necessary number of the AEM performance parts for reproduction. Then, the rendition style sequence section 21 interprets the rendition style event train object (namely, rendition style event data train) with the time stamps supplied from the easy player section 20 and sets (buffers) the rendition style event data train on the part-by-part basis. Thus, the sequential readout of the rendition style event data after the receipt of the sequence reproduction start instruction is carried out for each of the performance parts. Therefore, in the following description, a phrase "read out in advance an event following a given event" or something like that discusses two successive events in the rendition style event data train of a same performance part. The terms "part" or "performance part" in the following description refers to an "AEM performance part".

Other Preliminary Operation:

As another preliminary operation than the above-described part management, the rendition style sequence section 21 performs a process in accordance with time parameters taking into consideration various operational time delays. Examples of the time parameters include the following.

"Time period Corresponding to Output Frequency of the Rendition Style Sequence Section": As noted earlier, this is a parameter for setting a frequency with which the rendition style sequence section 21 should output the performance event data to the performance part section 22 and succeeding processing sections. Namely, at a given output time point (current time point), the rendition style sequence section 21 collectively sends out the performance event data present within the corresponding time period. Note that the instant embodiment is arranged to not only read out the performance events of the current time (more specifically, performance events present in the current time period) but also read out in advance one or more succeeding (future) performance events so as to send the thus read-out performance events to the performance part section 22, as will be later described in detail. In the performance part section 22 and following processing sections, necessary operations for rendition style waveform reproduction are carried out on the basis of the performance event data supplied every such time period "Advance Processing Time in the Rendition Style Sequence Section": This is a parameter for setting how far the rendition style sequence section 21 should process information in advance.

"Latency Period before Initiation of Tone Generation": This a parameter for offsetting an operational delay time at the beginning of sequence reproduction. Namely, an operation start time in the waveform synthesis section 24 is set apparently ahead of the sequence reproduction start position by an amount equal to this tone generation latency period; namely, the sequence reproduction start position is delayed by the tone generation latency period. More specifically, because, at the beginning of the sequence reproduction, the rendition style waveform producing processing has to be performed collectively not only on the performance events present within the time period corresponding to the output frequency of the rendition style sequence section 21 but also on the performance events to be processed for the advance processing time, a delay time that would result from the collective processing is set as the tone generation latency period to allow for the processing load, to thereby compensate for the operational time delay at the beginning of the reproduction.

"Prefetch Time for Access to the Code Book": This is a time parameter for setting how far the data after the current time should be read in advance or prefetched by the waveform synthesis section 24 from the hard disk (i.e., the code book stored therein) into the RAM. The rendition style sequence section 21 sets data of this prefetch time in the waveform synthesis section 24.

"Latency Period before Output to Audio Device": This is a time parameter for setting how earlier than operating timing of an output audio device the waveform synthesis section 24 should start performing the waveform synthesis process. The rendition style sequence section 21 sets data of this latency period in the waveform synthesis section 24. For example, the waveform synthesis section 24 performs control to write synthesized waveform data into an output buffer that is used later than its operating timing by the latency period.

The above-described time parameters may be fixed at respective predetermined values or may be variably set by the user. In the latter case, the time parameters are variably set by a setting operation of the easy player section 20.

Figures 7A, 7B:
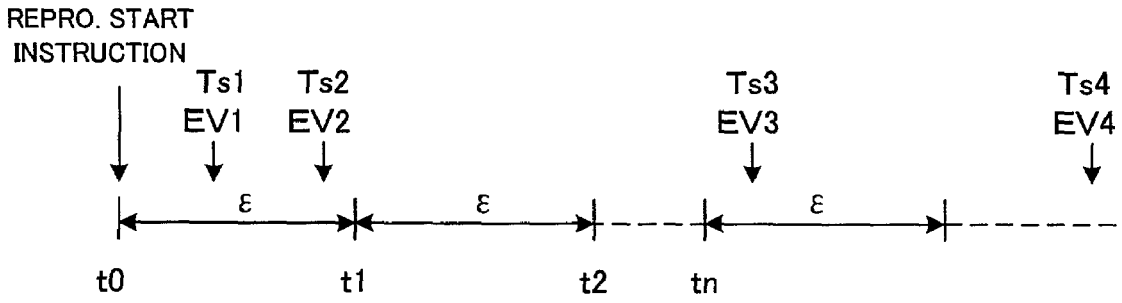
FIG. 7A is a diagram showing an example of a rendition style event train object.
FIG. 7B is a timing chart showing a relationship between timing for processing a current rendition style event and advance readout of a succeeding rendition style event.

Advance Readout of Future Event:

Let it now be assumed that a rendition style event train object of a given performance part is buffered, in the memory associated with the rendition style sequence section 21, in a manner as shown in FIG. 7A. In the figure, EV1, EV2, . . . represent individual events, and Ts1, Ts2, . . . represent time stamps corresponding to the events. Let's also assume that an initial value of a readout pointer to this memory is set to correspond to an initial time point t0.

FIG. 7B is a timing chart schematically showing event processing timing of the rendition style sequence section 21. First event processing timing arrives when a sequence reproduction start instruction has been given from the easy player section 20, and the first event processing timing is set as the initial time point t0. Succeeding processing timing arrives each time the time period corresponding to the output frequency of the rendition style sequence section 21 elapses, and these succeeding processing timing is set as time points t1, t2 . . . At the initial time point to, the rendition style sequence section 21 reads out, from the memory of FIG. 7A, the events present within a current time zone specified by the first time period (current events) along with the time stamps. Because each event includes a rendition style ID, parameters, etc. as noted earlier, all of these data pertaining to the event are read out together as a single set. FIG. 7B illustrates a case where first and second events EV1 and EV2 are present within the time zone specified by the first time period; the first event EV1 is normally a rendition style event of an attack portion that is processed together with (in paired relation to) the next note-on event EV2 as noted earlier. Of course, in some case, no event is present within the current time zone. Time positions of the individual events EV1, EV2, . . . can be identified from the respective time stamps Ts1, Ts2, . . .

In the instant embodiment, the rendition style sequence section 21 reads out not only such current rendition style events but also one or more rendition style events present within the next time period (future events). Namely, in the illustrated example of FIG. 7B, the next rendition style event EV3 is read out in advance at the same time as the events EV1 and EV2. The thus read-out current and future rendition style events EV1, EV2 and EV3 with the respective time stamps are passed to the following performance part section 22. These operations are carried out on the part-by-part basis, after which the rendition style sequence section 21 is placed in a waiting or standby state.

With the above-described arrangement that not only the current rendition style events but also the next (future) rendition style events are read out and delivered to the performance part section 22, waveform synthesis for rendition style modules pertaining to the current rendition style events can be performed in the part section 22 and subsequent processing sections, taking into consideration relationships between the rendition style modules based on successive performance events. For example, appropriate processing can be applied to achieve a smooth connection between rendition style waveforms pertaining to the rendition style modules based on the successive performance events.

Further, in the illustrated example of FIG. 7B, the processing by the rendition style sequence section 21 is resumed upon arrival of the next processing time point t1. In case no event is present, the rendition style sequence section 21 processes nothing. When the processing by the rendition style sequence section 21 is resumed upon arrival of the processing time point tn and if the rendition style event EV3 is present within the current time zone corresponding to the time point tn, the rendition style sequence section 21 reads out every event present within the current time period (i.e., every current event) and also reads out in advance every event present within the next time period (every future event). Because the performance part section 22 stores every received event and preserves it until the corresponding event process is performed, each already-read-out event need not be read out again here. Namely, in the example of FIG. 7B, the event EV3 present within the current time period corresponding to the processing time point tn, which has already been read out as the future event during the last readout, need not be read out again. In the event that the further next event EV4 is necessary for processing of the current event EV3, the event EV4 and its time stamp are read out and supplied to the performance part section 22. In this case, the performance part section 22 adjusts the connecting relationships between the rendition style modules pertaining to the already-received current event EV3 and currently-received future event EV4.

In FIG. 6, small blocks 311*a*, 311*b*, 311*c*, . . . illustrate timing at which the above-described event readout of the current and future events is carried out by the rendition style sequence section 21.

(3) Performance Part Section 22:

The performance part section 22 stores each rendition style event with the time stamp having been sent from the rendition style sequence section 21, performs a predetermined rehearsal process on the basis of the rendition style event, and manages a process to be performed in the following rendition style synthesis section 23. These operations of the performance part section 22 are also carried out on the part-by-part basis. In FIG. 6, small blocks 321*a*, 321*b*, 321*c*, . . . illustrate timing at which the rehearsal process is carried out by the performance part section 22.

Rehearsal Process:

The rehearsal process is intended to achieve smooth connections in time and level value between the respective start and end points of the various waveform-constituting elements, such as waveform shapes (Timbre), amplitudes and pitches, of successive rendition style waveforms after the rendition style synthesis is performed. For this purpose, the rehearsal process, prior to the actual rendition style synthesis, reads out the vector IDs, trains of representative sample point numbers and parameters corresponding to the rendition style events by way of a "rehearsal", and performs simulative rendition style synthesis on the basis of the thus read-out information, to thereby set appropriate parameters for controlling the time and level values at the start and end points of the successive rendition style modules. Thus, the successive rendition style waveforms can be interconnected, for each of the waveform-constituting elements such as the waveform shape, amplitude and pitch, by the rendition style synthesis section 23 performing a rendition style synthesis process using the parameters having been set on the basis of the rehearsal process. Namely, instead of adjusting or controlling already-synthesized rendition style waveforms or waveform-constituting elements to achieve a smooth connection between the rendition style waveforms or waveform-constituting elements, the performance part section 22 in the instant embodiment, immediately before actually synthesizing the rendition style waveforms or waveform-constituting elements, performs the "rehearsal" process to simulatively synthesize the rendition style waveforms or waveform-constituting elements and thereby set optimal parameters related to the time and level values at the start and end points of the rendition style modules. Then, the rendition style synthesis section 23 performs actual synthesis of successive rendition style waveforms or waveform-constituting elements using the thus-set optimal parameters, so that the successive rendition style waveforms or waveform-constituting elements can be interconnected smoothly.

Figure 8:
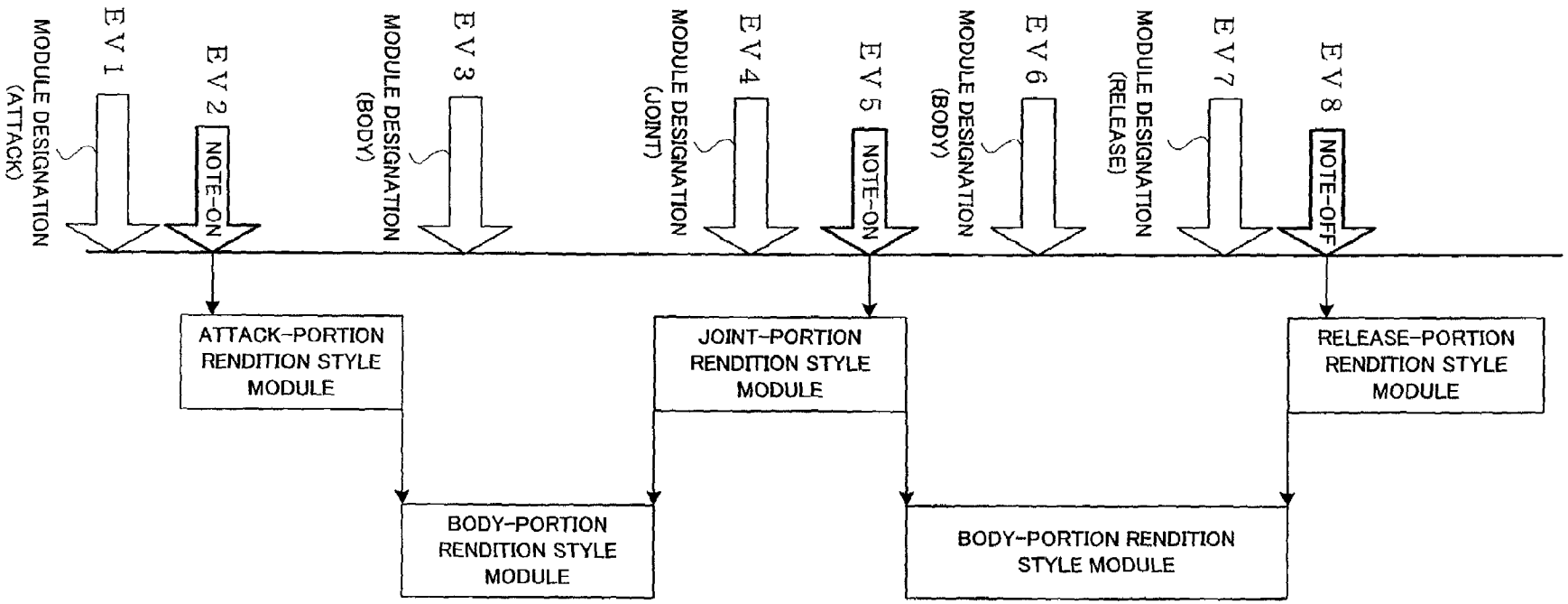
FIG. 8 is a timing chart showing an exemplary manner in which rendition style modules from the beginning to end of a tone to be generated are combined.

In the rehearsal process, necessary operations are carried out depending on the type or character of rendition style modules to be processed. Although a main object to be processed in the rehearsal process is the rendition style event, occurrence times of note-on and note-off events are also considered. For reference purposes, FIG. 8 shows an example of a manner in which rendition style modules from the beginning to end of a tone to be generated are combined. The combination shown in FIG. 8 includes (1) a rendition style event EV1 designating a rendition style module of an attack (entrance) portion, (2) note-on event EV2, (3) rendition style event EV3 designating a rendition style module of a body portion, (4) rendition style event EV4 designating a rendition style module of a joint portion, (5) note-on event EV5, (6) rendition style event EV6 designating a rendition style module of a body portion, (7) rendition style event EV7 designating a rendition style module of a release (finish) portion and (8) note-off event EV8, in the order mentioned.

In the illustrated example of FIG. 8, when a rendition style waveform is to be synthesized in accordance with the attack (entrance)-portion rendition style module designated by the rendition style event EV1 and note-on event EV2 then set as current events, the next rendition style event EV3 is read out in advance as a future event as set forth earlier, in response to which the rehearsal process determines necessary parameters for a smooth connection between the two rendition style modules. Then, when a rendition style waveform is to be synthesized in accordance with the body-portion rendition style module designated by the rendition style event EV3 then set as a current event, the next rendition style event EV4 designating a joint-portion rendition style module and note-on event EV5 are read out in advance as future events, in response to which the rehearsal process determines necessary parameters for a smooth connection between the two rendition style modules. Similarly, when a rendition style waveform is to be synthesized in accordance with the joint-portion rendition style module designated by the rendition style event EV4 and note-on event EV5 then set as current events, the next rendition style event EV6 is read out in advance as a future event as set forth earlier, in response to which the rehearsal process determines necessary parameters for a smooth connection between the two rendition style modules. In the illustrated example, the tone to be generated in response to the first note-on event EV2 and the tone to be generated in response to the next note-on event EV5 are interconnected via the rendition style waveform of the joint portion. Similarly, when a rendition style waveform is to be synthesized in accordance with the body-portion rendition style module designated by the further next rendition style event EV6 then set as a current event, the following rendition style event EV7 designating a release-portion rendition style module and note-off event are read out in advance as future events, in response to which the rehearsal process determines necessary parameters for a smooth connection between the two rendition style modules. Furthermore, when a rendition style waveform is to be synthesized in accordance with the release (finish)-portion rendition style module designated by the rendition style event EV7 and note-off event EV8 then set as current events, the rehearsal process taking a further next event into consideration is not carried out because the rendition style waveform of the release (finish) portion is terminated in response to the note-off or tone deadening instruction and thus need not be connected with a next rendition style waveform.

The following paragraphs describe specific examples of the rehearsal process in relation to several types of rendition style modules.

<Attack (Entrance) Module>

Figure 9A:
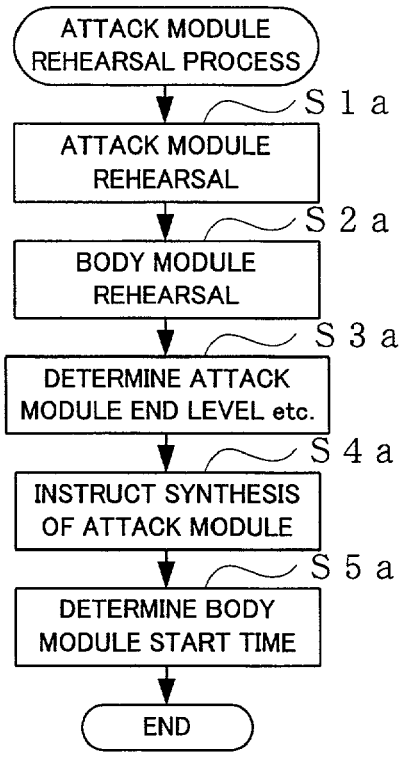
FIGS. 9A to 9D are flow charts showing examples of rehearsal processes corresponding to various rendition style modules.

FIG. 9A is a flow chart showing an exemplary step sequence of the rehearsal process when the current event designates a rendition style module of an attack (entrance) portion ("Attack Module Rehearsal Process").

At step S1*a*, each rendition style event to be currently processed (current event) (events EV1 and EV2 in the illustrated example of FIG. 8) is sent to the rendition style synthesis section 23, and the vector IDs, trains of representative sample point numbers (Shape) and other parameters corresponding to the rendition style ID designating a particular attack-portion rendition style module are read out, as rehearsal data, from the above-mentioned rendition style table by the synthesis section 23. The thus read-out rehearsal data are given to the performance part section 22, on the basis of which the part section 22 determines or adjusts parameters (control data), such as levels and time values, in the manner to be described below.

At step S2*a*, a next rendition style event or future event obtained by advance readout (event EV3 in the illustrated example of FIG. 8) is sent to the rendition style synthesis section 23, and the vector IDs, trains of representative sample point numbers (Shape) and other parameters corresponding to the rendition style ID designating a particular body-portion rendition style module are read out, as rehearsal data, from the rendition style table by the synthesis section 23. The thus read-out rehearsal data are given to the performance part section 22, on the basis of which the part section 22 determines or adjusts parameters (control data), such as levels and time values, in the manner to be described.

At next step S3*a*, predetermined level and time data for the rendition style module pertaining to the current rendition style event are determined on the basis of the read-out data of the current and next rendition style events. Thus, it is only necessary for steps S1*a* and S2*a* above to read out, from the rendition style table, data necessary for the operation of this step. Exemplary details of the rehearsal process to be performed here are described below with reference to (a), (b), (c) and (d) of FIG. 10.

Figure 10:
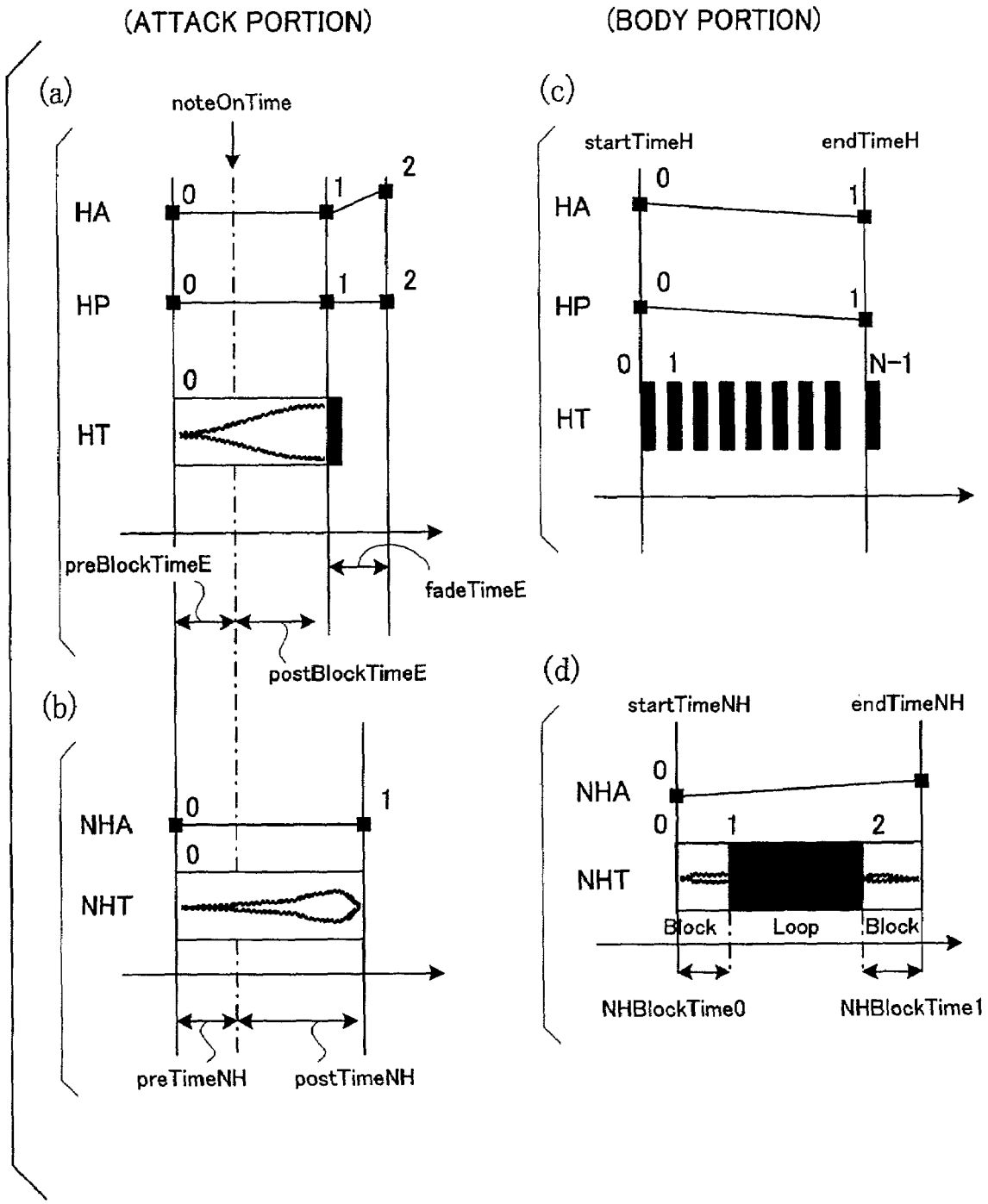
FIG. 10 is a diagram showing examples of vectors of harmonic and nonharmonic components in an attack-portion rendition style module (sections (a) and (b)), and examples of vectors of harmonic and nonharmonic components in a body-portion rendition style module (sections (c) and (d))

Section (a) of FIG. 10 shows examples of the vectors of the harmonic component in the attack-portion rendition style module; specifically, "HA" represents a train of representative sample point numbers (in the illustrated example, three sample points "0", "1" and "2") of the amplitude vector of the harmonic component, "HP" represents a train of representative sample point numbers (in the illustrated example, three sample points "0", "1" and "2") of the pitch vector of the harmonic component, and "HT" shows an example of the waveform shape vector of the harmonic component (the waveform shape is shown here only by its envelope). Note that the harmonic component's waveform shape vector HT basically comprises sample data representing an entire waveform section of a rise portion of a tone, and has data representative of a loop waveform segment at the end of the waveform section. The data representative of the loop waveform segment are read out in a repeated or looped fashion for cross-fade synthesis with an immediately succeeding waveform section. Parameter "preBlockTimeE", defining a start time of the harmonic component in the attack-portion rendition style module, specifies a difference between an actual tone-generation start point and a waveform-generation start time of the harmonic component in the attack waveform. For this purpose, the time stamp of the corresponding note-on event (event EV2 in the example of FIG. 8) is obtained to know the actual tone-generation start point ("noteOnTime" in the example of FIG. 10), and the difference between the actual tone-generation start point and the start time represented by the parameter "preBlockTimeE" ("noteOnTime"–"preBlockTimeE") is set as the start time of the harmonic component in the attack-portion rendition style module.

Of various parameters defining an end time of the harmonic component in the attack-portion rendition style module, "postBlockTimeE" is a parameter defining a difference between the actual tone-generation start point and an end time point of the body of the harmonic component in the attack waveform, and "fadeTimeE" is a parameter defining a cross-fading time length at the end of the attack waveform. Thus, the end time "endTimeH" of the harmonic component in the attack-portion rendition style module including the cross-fade end portion can be determined as "noteOnTime+(postBlockTimeE+fadeTimeE)". This end time "endTimeH" is send to the rendition style synthesis section 23 as data defining a start time of the harmonic component in a rendition style module designated by a next rendition style event (event EV3 in the example of FIG. 8). In this way, the rehearsal process is carried out to set a start time of the harmonic component of the next rendition style module in accordance with the above-mentioned end time "endTimeH" of the harmonic component.

Section (b) of FIG. 10 shows examples of the vectors of the nonharmonic component in the attack-portion rendition style module; specifically, "NHA" represents a train of representative sample point numbers (in the illustrated example, two sample points "0" and "1") of the amplitude vector of the nonharmonic component, and "NHT" shows an example of the waveform shape vector of the nonharmonic component (the waveform shape is shown here only by its envelope). Parameter "preTimeNH", defining a start time of the nonharmonic component in the attack-portion rendition style module, specifies a difference between an actual tone-generation start point and a waveform-generation start time of the nonharmonic component in the attack waveform. For this purpose, the time stamp of the corresponding note-on event (event EV2 in the example of FIG. 8) is obtained to know the actual tone-generation start point ("noteOnTime" in the example of FIG. 10), and the difference between the actual tone-generation start point and the start time represented by the parameter "preTimeNH" ("noteOnTime"–"preTimeNH") is set as the start time of the nonharmonic component in the attack-portion rendition style module.

Parameter "postTimeNH", defining an end time of the nonharmonic component in the attack-portion rendition style module, is one specifying a difference between the actual tone-generation start point and an end time point of the nonharmonic component in the attack waveform. Thus, the end time "endTimeNH" of the nonharmonic component in the attack-portion rendition style module can be determined as "noteOnTime+postTimeNH". This end time "endTimeNH" is sent to the rendition style synthesis section 23 as data defining a start time of the nonharmonic component in a rendition style module designated by a next rendition style event (event EV3 in the example of FIG. 8). In this way, the rehearsal process is carried out to set a start time of the nonharmonic component in the next rendition style module in accordance with the above-mentioned end time "endTimeNH" of the nonharmonic component. As may be clear from the foregoing, the time adjustments of the nonharmonic component are carried out independently of those of the harmonic component.

For the amplitude and pitch levels, the rehearsal process makes adjustments for a match between the end-point levels or values at the end of the amplitude vector (e.g., position "2" of HA in (a) of FIG. 10) and pitch vector (e.g., position "2" of HP in (a) of FIG. 10) of the attack-portion rendition style module pertaining to the current rendition style event, and the start-point levels or values at the beginning of the amplitude vector (position "0" of HA in (c) of FIG. 10) and pitch vector (position "0" of HP in (c) of FIG. 10) of the body-portion rendition style module pertaining to the next rendition style event.

Section (c) of FIG. 10 shows examples of the vectors of the harmonic component in the body-portion rendition style module; specifically, "HA" represents a train of representative sample point numbers (in the illustrated example, two sample points "0" and "1") of the amplitude vector of the harmonic component, "HP" represents a train of representative sample point numbers (in the illustrated example, two sample points "0" and "1") of the pitch vector of the harmonic component, and "HT" shows an example of the waveform shape vector of the harmonic component (the waveform shape is shown here by black rectangular blocks). The waveform shape vector of the harmonic component in the body portion comprises N (N is an integral number) loop waveform segments as represented by N black rectangular blocks (0, 1, . . . , N-1), and a body-portion waveform of a predetermined time length is produced by sequentially reading out and connecting the successive loop waveform segments. If the time length of the body-portion waveform is to be decreased or increased (contracted or stretched), it just suffices to decrease or increase the looping or repetition time of the loop waveform segments. In case the time length of the body-portion waveform is to be decreased further, the body-portion waveform may be read out in a thinned-out manner, i.e. with desired one or more of the N loop waveform segments be skipped as appropriate. If, on the other hand, the time length of the body-portion waveform is to be increased further, desired two or more of the N loop waveform segments may be inserted additionally between the N loop waveform segments in predetermined order or randomly.

At step S2*a* in (a) of FIG. 9, data indicative of the level at the start point (start-point level) of the harmonic component's amplitude vector HA (position "0" of HA in (c) of FIG. 10) of the body-portion rendition style module pertaining to the next rendition style event is obtained from the rendition style table. Then, at next step S3*a*, a velocity value, volume setting value, etc. are added to the obtained start-point level data to thereby calculate an actual start-point level of the harmonic component's amplitude vector HA of the body-portion rendition style module, and the thus-calculated actual start-point level is set as an amplitude level (value) at the end point (position "2" of HA in (a) of FIG. 10) of the harmonic component in the attack-portion rendition style module pertaining to the current rendition style event.

Similarly, data indicative of the value at the start point (start-point level) of the harmonic component's pitch vector HP (position "0" of HP in (c) of FIG. 10) of the body-portion rendition style module pertaining to the next rendition style event is obtained from the rendition style table. Then, a pitch control value is added to the obtained start-point pitch value data to thereby calculate an actual start-point pitch value of the harmonic component's pitch vector HP of the body-portion rendition style module, and the thus-calculated actual start-point pitch value is set as a pitch value at the end point (position "2" of HP in (a) of FIG. 10) of the harmonic component in the attack-portion rendition style module pertaining to the current rendition style event.

Section (d) of FIG. 10 shows examples of the vectors of the nonharmonic component of the body-portion rendition style module; specifically, "NHA" represents a train of representative sample point numbers (in the illustrated example, two sample points "0" and "1") of the amplitude vector of the nonharmonic component, and "NHT" schematically shows an example of the waveform shape vector of the nonharmonic component. Here, the nonharmonic component's waveform shape vector includes three blocks; the first block comprises a full waveform section of the nonharmonic component's waveform shape for a predetermined time period "NHBlockTime0", the second block comprises a nonharmonic component's waveform shape to be looped (Loop), and the third block comprises a full waveform section of the nonharmonic component's waveform shape for a predetermined time period "NHBlockTime1. Adjustment of the time length of the nonharmonic component's waveform shape relative to the time length of the body portion is performed by adjusting the looped (repeated) reproduction length of the second block, i.e. the nonharmonic component's waveform shape to be looped (Loop).

At step S2*a* in (a) of FIG. 9, data indicative of the level at the start point of the nonharmonic component's amplitude vector NHA (position "0" of NHA in (d) of FIG. 10) of the body-portion rendition style module pertaining to the next rendition style event is obtained from the rendition style table. Then, at next step S3*a*, a velocity value, volume setting value, etc. are added to the obtained start-point level data to thereby calculate an actual start-point level of the nonharmonic component's amplitude vector NHA of the body-portion rendition style module, and the thus-calculated actual start-point level is set as an amplitude level (value) at the end point (position "1" of NHA in (d) of FIG. 10) of the nonharmonic component's amplitude vector in the attack-portion rendition style module pertaining to the current rendition style event.

Upon completion of the above-described operations, the rehearsal process goes to step S4*a* in (a) of FIG. 9, where it instructs the rendition style synthesis section 23 to initiate synthesis of an attack-portion rendition style module pertaining to the current rendition style event. At next step S5*a*, the end times of the harmonic and nonharmonic components "endTimeH" and "endTimeNH" for the current rendition style event (event EV1 in the example of FIG. 8), which have been determined in the above-described manner, are set as data defining module start times of the harmonic and nonharmonic components for the next rendition style event (event EV3 in the example of FIG. 8). Once the rehearsal process has been completed, the flow of FIG. 5 moves on to processing by the rendition style synthesis section 23 to be described later. The following paragraphs describe the rehearsal process carried out for other types of rendition style modules.

<Body-portion Module>

Figure 9B:
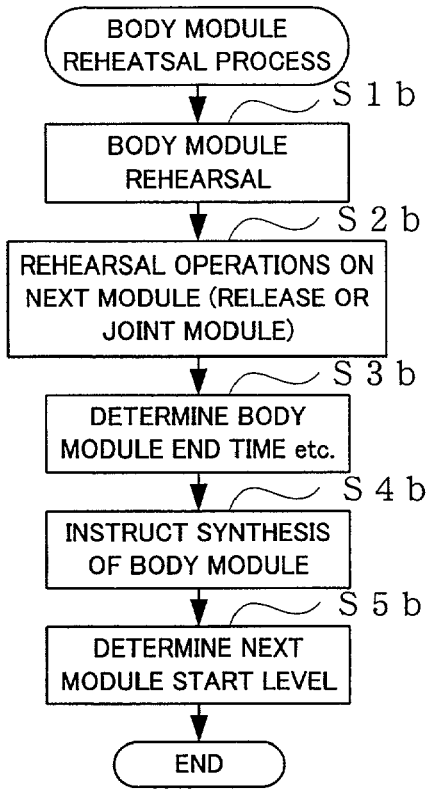

FIG. 9B is a flow chart showing an exemplary step sequence of the rehearsal process when the current event designates a rendition style module of a body portion ("Body Module Rehearsal Process").

At step S1*b*, each rendition style event to be currently processed (current event) (event EV3 or EV6 in the illustrated example of FIG. 8) is sent to the rendition style synthesis section 23, and the vector IDs, trains of representative sample point numbers (Shape) and other parameters corresponding to the rendition style ID designating a particular body-portion rendition style module are read out, as rehearsal data, from the above-mentioned rendition style table by the synthesis section 23. The thus read-out rehearsal data are given to the performance part section 22, on the basis of which the part section 22 determines or adjusts parameters (control data), such as levels and time values, in the manner to be described below. Note that those of the parameters having already been adjusted or changed during the rehearsal process for the last rendition style are used here as they are.

At step S2*b*, a next rendition style event or future event obtained by advance readout is sent to the rendition style synthesis section 23, and the vector IDs, trains of representative sample point numbers (Shape) and other parameters corresponding to the rendition style ID are read out and given to the performance part section 22, on the basis of which the part section 22 determines or adjusts parameters (control data), such as levels and time values, in the manner to be described. The body-portion designating rendition style event is followed by a rendition style event designating a release portion or joint portion. In the example of FIG. 8, the rendition style event EV4 designating a joint-portion rendition style module and corresponding note-on event EV5 follow the body-portion designating rendition style event EV3, and the rendition style event EV7 designating a release-portion rendition style module and corresponding note-off event EV8 follow the body-portion designating rendition style event EV6.

At steps S3*b* and S5*b*, predetermined time and level data of the rendition style module pertaining to the current rendition style event are determined or adjusted on the basis of the thus-obtained various data of the current and next rendition style events. At step S4*b*, the rehearsal process instructs the rendition style synthesis section 23 to initiate synthesis of a body-portion rendition style module pertaining to the current rendition style event.

Basically, the start time of the body-portion rendition style module is adjusted to match the end time of the immediately preceding rendition style module, and the end time of the body-portion rendition style module is adjusted to match a start time of the immediately succeeding rendition style module. Further, as the respective start- and end-point levels of the amplitude vectors of the harmonic and nonharmonic components and the start- and end-point levels of the pitch vector of the harmonic component of the body-portion rendition style module, those of the preceding and succeeding rendition style module are used. Namely, the rehearsal process is performed such that the end-point levels of the preceding rendition style module are set to match the start-point levels of the body-portion rendition style module and the start-point levels of the succeeding rendition style module are set to match the end-point levels of the body-portion rendition style module.

The start times of the harmonic and nonharmonic components of the body-portion rendition style module need not be determined here, because they have already been determined by the rehearsal process performed for the preceding rendition style event (e.g., the above-described attack-portion rendition style module event).

In order to determine the respective end times of the harmonic and nonharmonic components of the body-portion rendition style module, the next rendition style module (release or joint portion) is subjected to the rehearsal process at S2*b* so as to determine the respective start times of the harmonic and nonharmonic components of the next rendition style module. Then, at step S3*b*, the thus determined start times of the harmonic and nonharmonic components of the next rendition style module (release or joint portion) are determined as the respective end times of the harmonic and nonharmonic components of the current body-portion rendition style module.

Details of such time determining operations may be carried out in substantially the same manner as described above in relation to the attack-portion rendition style module.

Figure 11:
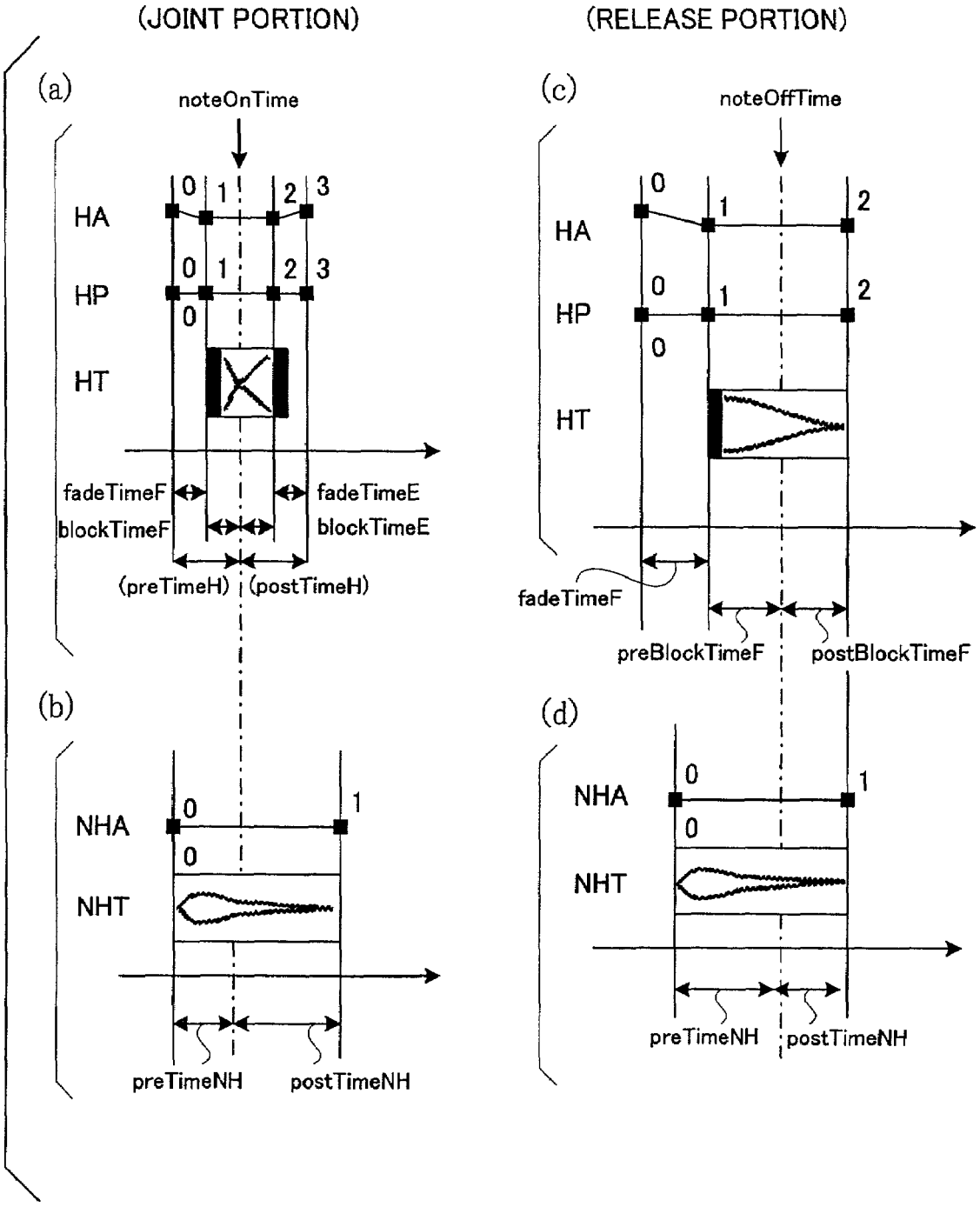
FIG. 11 is a diagram showing examples of vectors of harmonic and nonharmonic components in a joint-portion rendition style module (sections (a) and (b)), and examples of vectors of harmonic and nonharmonic components in a release-portion rendition style module (sections (c) and (d)).

For reference purposes, section (a) of FIG. 11 shows examples of the vectors of the harmonic component in the joint-portion rendition style module following the body-portion rendition style module, and section (b) of FIG. 11 shows examples of the vectors of the nonharmonic component in the joint-portion rendition style module. Reference characters "HA", "HP", "HT", "NHA", "NHT", etc. have the same meanings as explained earlier in relation to FIG. 10. In (a) of FIG. 11, a parameter "preTimeH", defining a start time of the harmonic component, specifies a difference between a note-on event occurrence time in the joint portion (event EV5 in the example of FIG. 8) and a waveform-generation start time of the harmonic component in the joint portion. In the rehearsal process, the time stamp of the note-on event (event EV5 in the example of FIG. 8) is obtained to know the actual tone-generation start point ("noteOnTime" in the example of (a) of FIG. 11), and the difference between the actual tone-generation start point and the start time represented by the parameter "preTimeH" ("noteOnTime"−"preTimeH") is set as the start time of the harmonic component in the joint-portion rendition style module. In this way, the start time of the harmonic component in the joint-portion rendition style module having been determined by the rehearsal process is set as the end time of the harmonic component in the body-portion rendition style module. Similarly, the rehearsal process is performed using a parameter "preTimeNH", denoted in (b) of FIG. 11 and defining a start time of the nonharmonic component, so that the start time of the nonharmonic component in the joint-portion rendition style module is determined and set as the end time of the nonharmonic component in the body-portion rendition style module.

The respective start-point levels of the amplitude vectors of the harmonic and nonharmonic components and start-point level of the pitch vector of the harmonic component in the body-portion rendition style module have already been set, by the rehearsal process performed for the preceding (e.g., attack-portion) rendition style module, as the respective end-point levels of the amplitude vectors of the harmonic and nonharmonic components and end-point level of the pitch vector of the harmonic component in the preceding (e.g., attack-portion) rendition style module.

Therefore, at next step S5*b*, the respective end-point levels of the amplitude vectors of the harmonic and nonharmonic components and end-point level of the pitch vector of the harmonic component in the body-portion rendition style module are set as start-point levels of the amplitude vectors of the harmonic and nonharmonic components and start-point level of the pitch vector of the harmonic component in a rendition style module designated by a next rendition style event (future event).

Details of such level determining operations may be carried out in substantially the same manner as described above in relation to the attack-portion rendition style module. Namely, data indicative of the level at the end point of the harmonic component's amplitude vector HA (position "1" of HA in (c) of FIG. 10) of the body-portion rendition style module pertaining to the current rendition style is obtained from the rendition style table. Then, a velocity value, volume setting value, etc. are added to the obtained end-point level data to thereby calculate an actual end-point level of the harmonic component's amplitude vector HA of the body-portion rendition style module, and the thus-calculated actual end-point level is set as an amplitude level (value) at the start point (position "0" of HA in (a) of FIG. 11) of the harmonic component's amplitude vector of the rendition style module pertaining to the next rendition style event. Similarly, data indicative of the value at the end point of the harmonic component's pitch vector HP (position "1"

of HP in (c) of FIG. 10) of the body-portion rendition style module pertaining to the current rendition style event is obtained from the rendition style table. Then, a control value is added to the obtained end-point pitch value data to thereby calculate an actual end-point pitch value of the harmonic component's pitch vector HP of the body-portion rendition style module, and the thus-calculated actual end-point pitch value is set as a pitch value at the start point (position "0" of HP in (a) of FIG. 11) of the harmonic component's pitch vector of the body-portion rendition style module pertaining to the next rendition style event.

Similarly, data indicative of the level at the end point of the nonharmonic component's amplitude vector NHA (position "1" of NHA in (d) of FIG. 10) of the body-portion rendition style module pertaining to the current rendition style event is obtained from the rendition style table. Then, a velocity value, volume setting value, etc. are added to the obtained start-point level data to thereby calculate an actual end-point level of the nonharmonic component's amplitude vector NHA of the body-portion rendition style module, and the thus-calculated actual end-point level is set as an amplitude level (value) at the start point (position "0" of NHA in (b) of FIG. 11) of the nonharmonic component's amplitude vector of the rendition style module pertaining to the next rendition style event.

<Joint-portion Module>

Figure 9C:
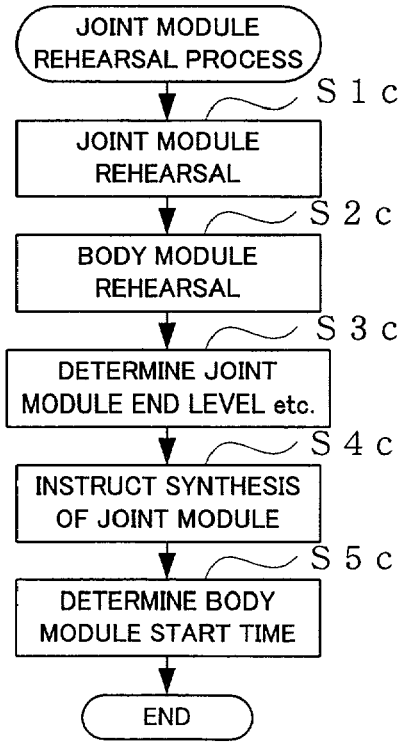

FIG. 9C is a flow chart showing an exemplary step sequence of the rehearsal process when the current event designates a rendition style module of a joint portion ("Joint Module Rehearsal Process").

At step S1*c*, each rendition style event to be currently processed (current event) (events EV4 and EV5 in the illustrated example of FIG. 8) is sent to the rendition style synthesis section 23, and the vector IDs, trains of representative sample point numbers (Shape) and other parameters corresponding to the rendition style ID designating a particular joint-portion rendition style module are read out, as rehearsal data, from the above-mentioned rendition style table by the rendition style synthesis section 23. The thus read-out rehearsal data are given to the performance part section 22, on the basis of which the part section 22 determines or adjusts parameters (control data), such as levels and time values, in the manner to be described below. Note that those of the parameters having already been adjusted or changed during the rehearsal process for the preceding rendition style are used here as they are.

At step S2*c*, a next rendition style event or future event obtained by advance readout is sent to the rendition style synthesis section 23, and the vector IDs, trains of representative sample point numbers (Shape) and other parameters corresponding to the rendition style ID are read out and given to the performance part section 22, on the basis of which the part section 22 determines or adjusts parameters (control data), such as levels and time values, in the manner to be described. The joint-portion designating rendition style event is followed by a rendition style event designating a second body portion (e.g., event EV6 in the example of FIG. 8).

At steps S3*c* and S5*c* of FIG. 9C, predetermined time and level data for the rendition style module pertaining to the current rendition style event are determined or adjusted on the basis of the thus-obtained various data of the current and next rendition style events. At step S4*c*, the rehearsal process instructs the rendition style synthesis section 23 to initiate synthesis of the joint-portion rendition style module pertaining to the current rendition style event.

Basically, in the rehearsal process, the respective start-point levels of the amplitude vectors of the harmonic and nonharmonic components and start-point level of the pitch vector of the harmonic component in the joint-portion rendition style module are adjusted to match the end-point levels of the corresponding vectors of the preceding body-portion rendition style module (e.g., EV3 in the example of FIG. 8), and the respective end-point levels of the amplitude vectors of the harmonic and nonharmonic components and end-point level of the pitch vector of the harmonic component in the joint-portion rendition style module are adjusted to match start-point levels of the corresponding vectors of a succeeding body-portion rendition style module (e.g., EV6 in the example of FIG. 8).

Note that the respective start-point levels of the amplitude vectors of the harmonic and nonharmonic components and start-point level of the pitch vector of the harmonic component in the joint-portion rendition style module have already been determined by the rehearsal process performed for the preceding rendition style event (step S5*b* in FIG. 9B), and hence these start-point levels are used here. Accordingly, the operation of at step S3*c* is performed, using the rehearsal results of the next body-portion rendition style module acquired at step S2*c* above, in such a manner that the respective end-point levels of the amplitude vectors of the harmonic and nonharmonic components and start-point level of the pitch vector of the harmonic component in the joint-portion rendition style module are set to correspond with the start-point levels of the corresponding vectors of the succeeding rendition style module. The operation of step S3*c* may be performed in a similar manner to step S3*a* of FIG. 9A and hence will not be descried in detail here.

Start times of the joint-portion rendition style module are set in substantially the same manner as described above in relation to (a) of FIG. 11. Namely, the time stamp of the next event, i.e. note-on event, (event EV5 in the example of FIG. 8) is obtained to know the actual tone-generation start point ("noteOnTime" in the example of (a) of FIG. 11), and the difference between the actual tone-generation start point and the start time represented by the parameter "preTimeH" ("noteOnTime"−"preTimeH") is set as the start time of the harmonic component of the joint-portion rendition style module. Start time of the nonharmonic component of the joint-portion rendition style module is also determined in substantially the same manner as described above in relation to (b) of FIG. 11. These start times may be determined during the rehearsal operation of step S1*c*.

End times of the joint-portion rendition style module are also set in substantially the same manner as described above in relation to (a) of FIG. 11. Namely, because the parameter "postTimeH", defining an end time of the harmonic component, specifies a difference between a next note-on event occurrence time in the joint portion (event EV5 in the example of FIG. 8) and a waveform-generation end time of the harmonic component of the joint portion, the time specified by the parameter "postTimeH" is added to the occurrence time "noteOnTime of the in the joint portion (event EV5 in the example of FIG. 8), and the resulting sum "noteOnTime+postTimeH" is determined as the end time of the harmonic component of the joint-portion rendition style module. Thus, at step S5*c*, the end time of the harmonic component in the joint-portion rendition style module having been determined by the rehearsal process is set as a start time of the harmonic component in a next body-portion rendition style module. Similarly, the rehearsal process is performed using a parameter "postTimeNH", denoted in (b) of FIG. 11 and defining an end time of the nonharmonic component, so that the end time of the nonharmonic component in the joint-portion rendition style module is determined and set as a start time of the nonharmonic component in the next body-portion rendition style module.

<Release (Finish) Module>

Figure 9D:
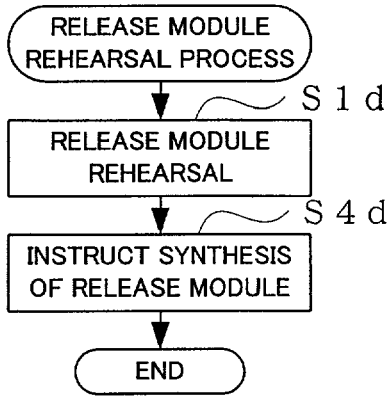

FIG. 9D is a flow chart showing an exemplary step sequence of the rehearsal process when the current event designates a rendition style module of a release (finish) portion ("Release Module Rehearsal Process").

At step S1*d*, each rendition style event to be currently processed (current event) (events EV7 and EV8 in the illustrated example of FIG. 8) is sent to the rendition style synthesis section 23, and the vector IDs, trains of representative sample point numbers (Shape) and other parameters corresponding to the rendition style ID designating a particular release-portion rendition style module are read out, as rehearsal data, from the above-mentioned rendition style table by the rendition style synthesis section 23. The thus read-out rehearsal data are then given to the performance part section 22, on the basis of which the part section 22 determines or adjusts parameters (control data), such as levels and time values, in the manner to be described below. Note that those of the parameters having already been adjusted or changed during the rehearsal process for the preceding rendition style event are used here as they are. Normally, at this stage, all data necessary for the current rendition style event have already been obtained by the rehearsal process performed for the previous rendition style events, and thus, in practice, this step S1*d* may be dispensed with.

For reference purposes, section (c) of FIG. 11 shows examples of the vectors of the harmonic component in the release-portion rendition style module, and section (d) of FIG. 11 shows examples of the vectors of the nonharmonic component in the release-portion rendition style module. Reference characters "HA", "HP", "HT", "NHA", "NHT", etc. have the same meanings as explained earlier in relation to FIG. 10. In (c) of FIG. 11, of parameters defining a start time of the harmonic component, "fadeTimeF" is a parameter specifying a time for cross-fade synthesis between a trailing waveform segment of the preceding rendition style module and a leading waveform segment of the release-portion rendition style module, and "preBlockTimeF" is a parameter specifies a time difference between the end time of the cross-fade synthesis and an occurrence time of a next event, i.e. note-off event, (event EV8 in the example of FIG. 8). Start time of the harmonic component in the release-portion rendition style module is determined on the basis of the occurrence time of the note-off event "noteOffTime", namely, by "noteOffTime−(fadeTimeF+preBlockTimeF). Start time of the nonharmonic component in the release-portion rendition style module is determined by "noteOffTime−preTimeNH. These start times have already been determined by the rehearsal process performed for the preceding body-portion rendition style module (steps S2*b* and S3*b* of FIG. 9B), and thus the already-determined start times can be used here.

The respective start-point levels of the amplitude vectors of the harmonic and nonharmonic components and start-point level of the pitch vector of the harmonic component in the release-portion rendition style module are adjusted to match the end-point levels of the corresponding vectors of the preceding body-portion rendition style module (e.g., EV6 in the example of FIG. 8). These levels too have already been determined by the rehearsal process performed for the preceding body-portion rendition style module (step S5*b* of FIG. 9B), and thus the already-determined levels can be used here.

Namely, because the rehearsal operations necessary for the tone-generation-terminating release (finish) portion should have been completed by now, the rehearsal operation of step S1*d* is unnecessary in practice. At step S4*d*, the rehearsal process instructs the rendition style synthesis section 23 to initiate synthesis of the release-portion rendition style module pertaining to the current rendition style event.

Note that the operations of steps S5*a*, S5*b* and S5*c* shown in FIGS. 9A to 9C may be performed during actual rendition style synthesis by the rendition style synthesis section 23, rather than during the rehearsal process by the performance part section 22.

(4) Rendition Style Synthesis Section 23:

In FIG. 5, the rendition style synthesis section 23 performs the predetermined rendition style synthesis process on the basis of the time-stamped rendition style event received from the performance part section 22 and data indicative of the results of the rehearsal process. In the rendition style synthesis process, the rendition style synthesis section 23 interprets and processes the rendition style ID and parameters or control data of the rendition style event, on the basis of which the synthesis section 23 reads out the individual vector IDs, representative point number trains and various parameters from the rendition style table. Then, the synthesis section 23 modifies, changes or processes the thus read-out data and parameters. Further, the synthesis section 23 packets (makes a packet of) the vector IDs, representative point number trains, various parameters, etc. and the parameters (control data), such as times and levels, determined by the rehearsal process, and outputs the packet as time-serial stream data. In FIG. 6, small blocks 331*a*, 331*b*, 331*c*, . . . illustrate timing at which the synthesis section 23 performs the rendition style synthesis process. Further, in FIG. 6, block 330 represents an output process section for outputting the packeted stream data, in which small blocks 330*a*, 330*b*, 330*c*, . . . illustrate output timing of the individual stream data.

(5) Waveform Synthesis Section 24:

In FIG. 5, the waveform synthesis section 24 receives, from the rendition style synthesis section 23, the packeted stream data including the vector IDs, representative point number trains, etc., reads out waveform template data and the like from the code book of the waveform database in accordance with the vector IDs ahead of the current time by the above-mentioned prefetch time, creates envelope waveform shapes of the amplitude and pitch vectors on the basis of the representative point number trains, parameters, etc. ahead of the current time by the above-mentioned output latency period, and then produces harmonic and nonharmonic components' waveforms of the rendition style waveform on the basis of the envelope waveform shapes and the like. After that, the synthesis section 24 pastes the harmonic and nonharmonic components' waveforms of the rendition style waveform to predetermined time positions in accordance with their respective time data and then additively synthesizes these waveforms to ultimately synthesize a rendition style waveform. Each reproduction time (i.e., current time) data established here is given to the easy player section 20 and used for real-time display of a changing reproduced position (time). In FIG. 6, blocks 341, 342, 343, . . . illustrate timing for data prefetch from the code book of the waveform database. Note that to allow the synthesis section 24 to create rendition style waveform data on the basis of the above-mentioned waveform template data, envelope waveform shapes of the amplitude and pitch vectors, etc. as noted above, there may be employed, for example, a technique commonly known as "software tone generator". The rendition style waveform data created by the synthesis section 24 are given to an output buffer that is provided within the waveform output section 108 of FIG. 1. Then, the rendition style waveform data thus stored in the output buffer are read out at a predetermined sampling frequency and audibly sounded via the sound system 108A of FIG. 1.

Whereas the embodiment has been described above as performing the data readout of each current rendition style event and advance data readout of a corresponding future rendition style event every predetermined time period, the present invention is not so limited; for example, the data readout of each current rendition style event and advance data readout of the corresponding future rendition style event may be performed at any desired time.

In summary, the present invention is characterized in that when a given piece of performance event information at a given time point is to be processed in accordance with the pieces of performance event information supplied in accordance with the order of time, another piece of performance event information related to one or more events following the given piece of performance event information is obtained in advance of a predetermined original time position of the other piece of performance event information and then control data corresponding to a rendition style module designated by at least one of the given piece of performance event information and the other piece of performance event information obtained in advance are generated on the basis of the given piece and the other piece of performance event information. This inventive arrangement permits creation of control data taking into consideration relationships between rendition style modules based on successive pieces of performance event information. For example, the present invention thus arranged can apply appropriate processing to the control data such that rendition style waveforms designated by rendition style modules based on successive pieces of performance event information can be interconnected smoothly.

What is claimed is:

1. A waveform production method comprising:

a step of supplying, in accordance with order of time, a plurality of rendition style event data designating rendition style modules, the rendition style event data including content data corresponding to a rendition style event, and timing data corresponding to a time position of the rendition style event;

a step of, when given rendition style event data at a given time point is to be processed in accordance with the plurality of rendition style event data supplied by said step of supplying in accordance with the order of time, obtaining other rendition style event data related to one or more events, following the given rendition style event data, in advance of a predetermined original time position of the other rendition style event data;

a step of generating control data corresponding to a rendition style module designated by at least one of the given rendition style event data and the other rendition style event data obtained in advance by said step of obtaining, on the basis of the given rendition style event data at said given time point and the other rendition style event data; and a step of synthesizing, on the basis of the control data, waveform data corresponding to the -rendition style module designated by said given rendition style event data at said given time point.

2. A waveform production method as claimed in claim 1 wherein said step of generating control data modifies the control data corresponding to the rendition style module designated by at least one of the given rendition style event data and the other rendition style event data obtained in advance, on the basis of the given rendition style event data and the other rendition style event data.

3. A computer-readable medium encoded with a computer program containing a group of instructions for causing a computer to execute the waveform production method as claimed in claim 1.

4. A waveform production apparatus comprising:

means for supplying, in accordance with order of time, a plurality of rendition style event data designating rendition style modules;

means for, when given rendition style event data at a given time point is to be processed in accordance with the plurality of rendition style event data supplied by said means for supplying in accordance with the order of time, obtaining other rendition style event data related to one or more events, following the given rendition style event data, in advance of a predetermined original time position of the other rendition style event data;

means for generating control data corresponding to a rendition style module designated by at least one of the given rendition style event data and the other rendition style event data obtained in advance by said means for obtaining, on the basis of the given rendition style event data and the other rendition style event data; and means for synthesizing, on the basis of the control data, waveform data corresponding to the rendition style module designated by said given rendition style event data at said given time point.

5. A waveform production apparatus comprising:

a supply device that supplies a plurality of rendition style event data designating rendition style modules; and a processor coupled with said supply device and adapted to:

cause said supply device to supply the plurality of rendition style event data in accordance with order of time;

when given rendition style event data at a given time point is to be processed in accordance with the plurality of rendition style event data supplied by said supply device in accordance with the order of time, obtain other rendition style event data related to one or more events, following the given rendition style event data, in advance of a predetermined original time position of the other rendition style event data;

generate control data corresponding to a rendition style module designated by at least one of the given rendition style event data and the other rendition style event data obtained in advance, on the basis of the given rendition style event data and the other rendition style event data; and synthesize, on the basis of the control data, waveform data corresponding to the rendition style module designated by said given rendition style event data at said giyen time point.

6. A waveform production method comprising:

a step of sequentially designating rendition style modules, said rendition style modules including elements of a harmonic component and a nonharmonic component;

a step of obtaining, for each of said elements of a harmonic component and a nonharmonic component, trailing end information related to a characteristic of at least a trailing end portion of a preceding rendition style module and leading end information related to a characteristic of at least a leading end portion of a succeeding rendition style module;

a step of modifying, for each of said elements of a harmonic component and a nonharmonic component, a characteristic of at least one of the preceding and succeeding rendition style modules on the basis of the trailing end information and leading end information obtained by said step of obtaining; and a step of synthesizing a waveform corresponding to the rendition style module, designated by said step of sequentially designating, in accordance with the characteristic modified by said step of modifying.

7. A waveform production method as claimed in claim 6 wherein each of the trailing end information and leading end information includes at least one of time information and level information.

8. A computer-readable medium encoded with a computer program containing a group of instructions for causing a computer to execute the waveform production method as claimed in claim 6.

9. A waveform production apparatus comprising:

means for sequentially designating rendition style modules, said rendition style modules including elements of a harmonic component and a nonharmonic component;

means for obtaining, for each of said elements of a harmonic component and a nonharmonic component, trailing end information related to a characteristic of at least a trailing end portion of a preceding rendition style module and leading end information related to a characteristic of at least a leading end portion of a succeeding rendition style module;

means for modifying, for each of said elements of a harmonic component and a nonharmonic component, a characteristic of at least one of the preceding and succeeding rendition style modules on the basis of the trailing end information and leading end information obtained by said means for obtaining; and means for synthesizing a waveform corresponding to the rendition style module, designated by said means for sequentially designating, in accordance with the characteristic modified by said means for modifying.

10. A waveform production apparatus comprising:

a database storing pieces of waveform producing information in corresponding relation to a plurality of rendition style modules; and a processor coupled with said database and adapted to:

sequentially accept designation of rendition style modules to be reproduced, said rendition style modules including elements of a harmonic component and a nonharmonic component;

obtain, for each of said elements of a harmonic component and a nonharmonic component, trailing end information related to a characteristic of at least a trailing end portion of a preceding rendition style module and leading end information related to a characteristic of at least a leading end portion of a succeeding rendition style module, in accordance with the designation of rendition style modules;

modify, for each of said elements of a harmonic component and a nonharmonic component, a characteristic of at least one of the preceding and succeeding rendition style modules on the basis of the obtained trailing end information and leading end information; and synthesize a waveform corresponding to each of the rendition style modules in accordance with the modified characteristic, with reference to said database.

11. A waveform production method comprising:

a step of supplying rendition style designation information each including information designating a rendition style module and parameter information for controlling the rendition style module, the parameter information differing in structure per type of rendition style module designatable by the information designating a rendition style module, representing differing types and numbers of parameter information;

a step of, when the supplied rendition style designation information is lacking in necessary parameter information, filling the lacking necessary parameter information with a standard parameter predetermined according to the type of the rendition style module, to thereby supplement the parameter information; and a step of synthesizing waveform data corresponding to the designated rendition style module on the basis of the rendition style designation information including the supplemented parameter information.

12. A computer-readable medium encoded with a computer program for causing a computer to execute the waveform production method as claimed in claim 11.

13. A waveform production apparatus comprising:

means for supplying rendition style designation information each including information designating a rendition style module and parameter information for controlling the rendition style module, the parameter information differing in structure per type of rendition style module designatable by the information designating a rendition style module, representing differing types and numbers of parameter information;

means for, when the supplied rendition style designation information is lacking in necessary parameter information, filling the lacking necessary parameter information with a standard parameter predetermined according to the type of the rendition style module, to thereby supplement the parameter information; and means for synthesizing waveform data corresponding to the designated rendition style module on the basis of the rendition style designation information including the supplemented parameter information.

14. A waveform production apparatus comprising:

a supply device that supplies rendition style designation information each including information designating a rendition style module and parameter information for controlling the rendition style module, the parameter information differing in structure per type of rendition style module designatable by the information designating a rendition style module, representing differing types and numbers of parameter information; and a processor coupled with said supply device and adapted to:

when the supplied rendition style designation information is lacking in necessary parameter information, fill the lacking necessary parameter information with a standard parameter predetermined according to the type of the rendition style module, to thereby supplement the parameter information; and synthesize waveform data corresponding to the designated rendition style module on the basis of the rendition style designation information including the parameter information.

15. A waveform production method comprising:

a step of supplying, in accordancewith order of time, pieces of performance event information designating rendition style modules; and a step of generating waveform data corresponding to a rendition style module on the basis of given performance event information, wherein when a waveform including at least attack and body portions is to be synthesized, said step of supplying supplies, as the performance event information, first module event data for designating a waveform of the attack portion, note-on event data and second module event data for designating a waveform of the body portion, and wherein said step of generating initiates generation of the waveform of the attack portion in response to said first module event data supplied before the note-on event data, and initiates generation of the waveform of the body portion in response to said second module event data supplied after the note-on event data.

16. A waveform production method as claimed in claim 15 wherein when a waveform including at least body and release portions is to be synthesized, said step of supplying supplies, as the performance event information, third module event data for designating a waveform of the release portion and note-off event data, following said second module event data for designating the waveform of the body portion, and wherein said step of generating initiates generation of the waveform of the release portion in response to said third module event data supplied before the note-off event data, after having generated the waveform of the body portion in response to said second module event data.

17. A computer-readable medium encoded with a computer program containing a group of instructions for causing a computer to execute the waveform production method as claimed in claim 15.

18. A computer-readable medium encoded with a computer program containing a group of instructions for causing a computer to execute the waveform production method as claimed in claim 16.

19. A waveform production apparatus comprising:

a supply device that supplies, in accordance with order of time, pieces of performance event information designating rendition style modules; and a processor coupled with said supply device and adapted to generate waveform data corresponding to a rendition style module on the basis of given performance event information, wherein when a waveform including at least attack and body portions is to be synthesized, said supply device supplies, as the performance event information, first module event data for designating a waveform of the attack portion, note-on event data and second module event data for designating a waveform of the body portion, and wherein said processor is adapted to initiate generation of the waveform of the attack portion in response to said first module event data supplied before the note-on event data, and initiate generation of the waveform of the body portion in response to said second module event data supplied after the note-on event data.

20. A waveform production apparatus as claimed in claim 19 wherein when a waveform including at least body and release portions is to be synthesized, said supply device supplies, as the performance event information, third module event data for designating a waveform of the release portion and note-off event data, following said second module event data for designating the waveform of the body portion, and wherein said processor is adapted to initiate generation of the waveform of the release portion in response to said third module event data supplied before the note-off event data, after having generated the waveform of the body portion in response to said second module event data.

21. A waveform production method comprising:

a step of supplying rendition style designation information each including information designating a rendition style module and parameter information for controlling the rendition style module;

a step of, when the supplied rendition style designation information is lacking in necessary parameter information, filling the lacking parameter information with a standard parameter predetermined according to the type of the rendition style module, to thereby supplement the parameter information, wherein parameter information used in previous waveform production, with respect to a parameter of a same type as the lacking parameter information, is used as the predetermined standard parameter; and a step of synthesizing a waveform corresponding to the designated rendition style module on the basis of the rendition style designation information including the supplemented parameter information.

22. A computer-readable medium encoded with a computer program containing a group of instructions for causing a computer to execute the waveform production method as claimed in claim 21.

23. A waveform production apparatus comprising:

a supply device that supplies rendition style designation information each including information designating a rendition style module and parameter information for controlling the rendition style module; and a processor coupled with said supply device and adapted to:

when the supplied rendition style designation information is lacking in necessary parameter information, fill the lacking parameter information with a standard parameter predetermined according to the type of the rendition style module, to thereby supplement the parameter information, wherein parameter information used in previous waveform production, with respect to a parameter of a same type as the lacking parameter information, is used as the predetermined standard parameter; and synthesize a waveform corresponding to the designated rendition style module on the basis of the rendition style designation information including the supplemented parameter information.

24. A waveform production method comprising:

a step of, where a waveform is to be produced by sequentially reading out, from a storage device, rendition style designation information each including information designating a rendition style module and parameter information for controlling the rendition style module, checking, prior to production of the waveform, whether or not necessary parameter information is included in the rendition style designation information stored in the storage device and, if not, adding, to the rendition style designation information, a standard parameter predetermined according to a type of the corresponding rendition style module as the necessary parameter information;

a step of, when the waveform is to be produced, reading out the rendition style designation information including the necessary parameter information in accordance with reproducing order; and a step of, on the basis of the read-out rendition style designation information including the necessary parameter information, synthesizing a waveform corresponding to the designated rendition style module.

25. A computer-readable medium encoded with a computer program containing a group of instructions for causing a computer to execute the waveform production method as claimed in claim 24.

26. A waveform production apparatus comprising:

a storage device that stores rendition style designation information each including information designating a rendition style module and parameter information for controlling the rendition style module; and a processor coupled with said supply device and adapted to:

where a waveform is to be produced by sequentially reading out, from said storage device, the rendition style designation information, check, prior to production of the waveform, whether or not necessary parameter information is included in the rendition style designation information stored in the storage device and, if not, add, to the rendition style designation information, a standard parameter predetermined according to a type of the corresponding rendition style module as the necessary parameter information;

when the waveform is to be produced, read out the rendition style designation information including the necessary parameter information in accordance with reproducing order; and on the basis of the read-out rendition style designation information including the necessary parameter information, synthesize a waveform corresponding to the designated rendition style module.

27. A waveform production method as claimed in claim 6, further comprising:

a step of rehearsing and simulatively synthesizing at least one of the preceding and succeeding rendition style modules on the basis of the trailing end information and leading end information and setting optimal parameters accordingly.

28. A waveform production apparatus as claimed in claim 9, further comprising:

means for rehearsing and simulatively synthesizing at least one of the preceding and succeeding rendition style modules on the basis of the trailing end information and leading end information and seffing optimal parameters accordingly.

29. A waveform production apparatus as claimed in claim 10, the processor further adapted to:

rehearse and simulatively synthesize at least one of the preceding and succeeding rendition style modules on the basis of the trailing end information and leading end information and setting optimal parameters accordingly.

* * * * *